US008528898B2

(12) United States Patent
Kushida

(10) Patent No.: US 8,528,898 B2
(45) Date of Patent: Sep. 10, 2013

(54) SHEET CONVEYING APPARATUS, SHEET PROCESSING APPARATUS, AND IMAGE FORMING APPARATUS

(75) Inventor: Hideki Kushida, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/302,287

(22) Filed: Nov. 22, 2011

(65) Prior Publication Data

US 2012/0146280 A1 Jun. 14, 2012

(30) Foreign Application Priority Data

Dec. 13, 2010 (JP) ..... 2010-276697

(51) Int. Cl.
*B65H 5/00* (2006.01)

(52) U.S. Cl.
USPC ..... 271/225; 271/303; 271/902

(58) Field of Classification Search
USPC ..... 271/291, 301, 303, 225, 902
See application file for complete search history.

(56) References Cited

U.S. PATENT DOCUMENTS

| | | | | |
|---|---|---|---|---|
| 5,951,004 | A * | 9/1999 | Hadfy-Kovacs et al. | 271/184 |
| 7,165,764 | B2 | 1/2007 | Nakamura et al. | |
| 7,354,034 | B2 | 4/2008 | Nakamura et al. | |
| 7,874,553 | B2 | 1/2011 | Kushida et al. | |
| 2004/0175217 | A1 | 9/2004 | Nakamura et al. | |
| 2007/0057434 | A1 | 3/2007 | Nakamura et al. | |
| 2007/0075479 | A1 | 4/2007 | Obuchi et al. | |
| 2009/0115129 | A1 | 5/2009 | Kushida | |
| 2011/0280625 | A1 | 11/2011 | Kushida et al. | |

FOREIGN PATENT DOCUMENTS

| | | | |
|---|---|---|---|
| EP | 1455241 | A1 | 9/2004 |
| EP | 1764324 | A2 | 3/2007 |
| EP | 1764324 | A3 | 3/2007 |
| EP | 1455241 | B1 | 5/2007 |
| JP | 2003-089471 | A | 3/2003 |
| JP | 2009-126629 | A | 6/2009 |

* cited by examiner

*Primary Examiner* — Michael McCullough

(74) *Attorney, Agent, or Firm* — Fitzpatrick, Cella, Harper & Scinto

(57) ABSTRACT

To convey a following sheet toward a discharge tray together with a preceding sheet made to wait in a buffer path, while a switch member provided at a branch portion of the path is maintained at a lower position, the following sheet conveyed from an upstream side of the branch portion toward the discharge tray is guided by a second guide face of the switch member at the lower position, made to meet the waiting sheet on a downstream side of the switch member, and conveyed toward the discharge tray in a sheet bundle.

21 Claims, 20 Drawing Sheets

SHEET CONVEYING APPARATUS, SHEET PROCESSING APPARATUS, AND IMAGE FORMING APPARATUS

BACKGROUND OF THE INVENTION

1. Field of the Invention

The present invention relates to a sheet conveying apparatus capable of causing a sheet to wait in a conveying route and to meet a following sheet and conveying them in a sheet bundle, a sheet processing apparatus including the sheet conveying apparatus, and an image forming apparatus including the sheet conveying apparatus.

2. Description of the Related Art

There is a known sheet processing apparatus for performing various kinds of sheet processes such as a binding process, a punching process, and a sorting process for sheets on which images are formed by an image forming apparatus such as a copying machine, a laser beam printer, and a facsimile. Conventionally, this type of sheet processing apparatus is provided with a portion (hereafter referred to as a buffering processing portion) in which a sheet is made to stay temporarily to avoid reduction in sheet processing productivity in a case of a process (e.g., the binding process) requiring a relatively long sheet processing time.

In such a sheet processing apparatus, the sheet is made to stay temporarily in the buffering processing portion and then conveyed downstream, with a following sheet conveyed from an upstream side in a sheet bundle of the plurality of sheets. In this way, the processing time for the sheet processing portion provided downstream is secured. In this manner, by causing the sheet to stay in the buffering processing portion provided to a conveying portion between the image forming apparatus and the sheet processing portion while the sheets are processed in the downstream portion and by not stopping discharge operation from the image forming apparatus, production capacity of a system in total is enhanced.

As disclosed in U.S. Patent Application Publication No. 2007/0075479 A1 and U.S. Patent Application Publication No. 2004/0175217 A1, for example, there is a sheet processing apparatus including a reversing-type buffering mechanism in which rear ends of the sheets are sorted by a switch member and the sheets are superimposed on each other a bundle while collision with a front end of a following sheet is prevented.

As illustrated in FIG. 18, a sheet processing apparatus in U.S. Patent Application Publication No. 2007/0075479 A1 has what is called a sheet buffering processing function for causing a plurality of superimposed sheets P to wait in a conveying route on an upstream side of a stapler 1132 and a saddle unit 1135. An operation flow of the buffering process is as follows.

When a rear end portion of a sheet P1 conveyed from a pair of inlet rollers 1102 is guided by and passes a lower face of a switch member 1114, a solenoid (not illustrated) is actuated and the switch member 1114 is turned down to guide the sheet P1 to a buffer path 1113. In this state, a pair of buffer rollers 1115 and 1116 are rotated reversely. As a result, the rear end of the sheet P1 enters the buffer path 1113 and then the sheet P1 is conveyed reversely until a front end of the sheet P1 arrives at a position B.

Then, the switch member 1114 is turned up so that a second sheet P2 can be conveyed toward the pair of buffer rollers 1116. At this time, a pair of reversing rollers 1112 is rotated at the time when a front end of the sheet P2 arrives at the position B to start conveying the sheet P1 toward the pair of buffer rollers 1116. With the front ends of the sheet P1 and the sheet P2 aligned with each other on a downstream side of the position B, the bundle of the two sheets is conveyed.

When a rear end portion of the sheet bundle of the sheets P1 and P2 passes the switch member 1114 similarly to the sheet P1, the switch member 1114 is turned down and the sheet bundle of the sheets P1 and P2 is conveyed to the buffer path 1113. In this way, the switch member 1114 is reciprocated every time the sheet passes to sequentially superimpose the sheets on each other to thereby bundle the sheets in the conveying route.

U.S. Patent Application Publication No. 2004/0175217 A1 is the sheet processing apparatus having a different buffering mechanism from U.S. Patent Application Publication No. 2007/0075479 A1.

As illustrated in FIG. 19, when a rear end of a sheet P1 passes a rear end holding member 2135 and arrives at a reversing point provided before a buffer roller 2124, the sheet P1 is returned to an upstream side (toward the rear end holding member 2135) by reverse rotation of the buffer roller 2124. At about the same time, the rear end holding member 2135 is separated from a lower conveying guide plate 2123*b* to open a rear end receiving portion 2136.

Then, the rear end holding member 2135 returns to an original position to press the sheet P1 against the lower conveying guide plate 2123*b* with a friction member of the rear end holding member 2135. Then, a second sheet P2 is sent in by a pair of inlet rollers 2121, passes over the rear end holding member 2135, and is conveyed by the buffer roller 2124 as well.

At this time, the sheet P1 is pressed against the lower conveying guide plate 2123*b* together with the sheet P2 by the buffer roller 2124 and tries to move toward a downstream side following the conveyed sheet P2. However, the sheet P1 does not move due to the friction member of the rear end holding member 2135.

Similarly to the sheet P1, when a rear end of the sheet P2 arrives at the reversing point, the sheet P2 is returned toward the upstream side (toward the rear end holding member 2135). Then, the sheet P2 is superimposed on the sheet P1 and pressed against the lower conveying guide plate 2123*b* by the friction member of the rear end holding member 2135.

Then, a third sheet (not illustrated) is sent and a rear end of the sheet passes the pair of inlet rollers 2121. The three sheets P1, P2, and P3 are nipped between a pair of upper first discharge rollers 2126*a* and a pair of lower first discharge rollers 2126*b* and the sheet bundle of these three sheets P1, P2, and P3 is conveyed to a downstream processing tray.

As described above, the prior-art sheet processing apparatus is of the buffering type in which the sheets are superimposed on each other in the bundle while the switch member for sorting the rear ends is reciprocated during intervals of the conveyed sheets. In this way, the apparatus provides satisfactory conveying performance and processing productivity.

However, in the buffering type in which the sheets are superimposed on each other in the bundle while the switch member is moved during the sheet interval for each sheet as in U.S. Patent Application Publication No. 2007/0075479 A1, the sheet interval when the sheet passes the switch member needs to be equal to or longer than a reciprocating time of the switch member. Therefore, it is difficult to adapt to a highly productive apparatus with short sheet conveying intervals.

Especially, because a thin sheet of 38 gsm to 52 gsm has a low mass per sheet and has low rigidity, discharge of the thin sheet to a stack tray is liable to be unstable. Therefore, to discharge such a thin sheet to the stack tray, a plurality of sheets needs to be bundled in the buffering processing portion before discharge so as to obtain a higher mass and rigidity to be discharged. However, as described above, the highly productive apparatus in which the sheets are conveyed at short intervals is difficult to adapt to the thin sheets of 38 gsm to 52 gsm.

Furthermore, in U.S. Patent Application Publication No. 2004/0175217 A1, because the reversing point is provided downstream of the rear end holding member 2135 for sorting of the rear ends, an upward opening operation control is performed so that the rear end portion is reliably conveyed to a lower of the rear end holding member 2135 at the time of reversal. In this way, the reciprocation for opening and closing the rear end holding member 2135 needs to be performed during the sheet interval for each sheet and therefore the apparatus is difficult to adapt to the highly productive apparatus similarly to U.S. Patent Application Publication No. 2007/0075479 A1.

As described above, in the prior-art sheet processing apparatus, the sheets are bundled while the switch member for sorting the rear ends is reciprocated during the sheet interval for each sheet and therefore there is a limit to processing velocity and it is difficult to increase productivity. Moreover, in the highly productive apparatus, it is difficult to buffer the sheets in a bundle. Therefore, it is difficult to discharge the plurality of thin sheets of 38 gsm to 52 gsm as a unit to improve stacking performance. As a result, the conveying performance and the stacking performance are difficult to improve.

SUMMARY OF THE INVENTION

Therefore, the present invention increases processing velocity for bundling and conveying sheets to increase productivity to be able to adapt to a highly productive apparatus.

Moreover, the invention enables the highly productive apparatus to bundle and convey thin sheets to thereby further improve the conveying performance and the stacking performance.

The present invention provides a sheet conveying apparatus which superimposes and conveys a plurality of sheets, including a common conveying route configured to convey a sheet in a first direction, a reverse conveying route which branches off from the common conveying route and conveys the sheet in a second direction opposite to the first direction, to make the sheet waiting in the reverse conveying route, a conveying portion which conveys the sheet in the first direction or in the second direction along the common conveying route or the reverse conveying route, a switch member which is provided at a branch portion between the common conveying route and the reverse conveying route, which can be switched between a first position for guiding the sheet in the first direction from an upstream side of the branch portion and a second position for guiding the sheet in the second direction from a downstream side of the branch portion, and which has a first guide face and a second guide face, located on a back of the first guide face, to guide the sheet, and a controlling portion which controls operations of the conveying portion and the switch member so that a preceding sheet, conveyed in the second direction to wait in the reverse conveying route, is guided by the first guide face of the switch member at the first position, and a following sheet, conveyed in the first direction to be superimposed with the preceding sheet waiting in the reverse conveying route, is guided by the second guide face of the switch member at the second position.

Further features of the present invention will become apparent from the following description of exemplary embodiments with reference to the attached drawings.

DESCRIPTION OF THE EMBODIMENTS

With reference to the drawings, exemplary embodiments of the present invention will be described below in detail as examples. However, dimensions, materials, shapes, and relative positions of component parts described in the following embodiments should be changed properly according to a structure of an apparatus to which the invention is applied and various conditions. Therefore, unless there is a specifying description, a scope of the invention is not limited to them.

First Embodiment

A sheet processing apparatus and an image forming apparatus having a sheet conveying apparatus according to a first embodiment will be described.

Figure 1:
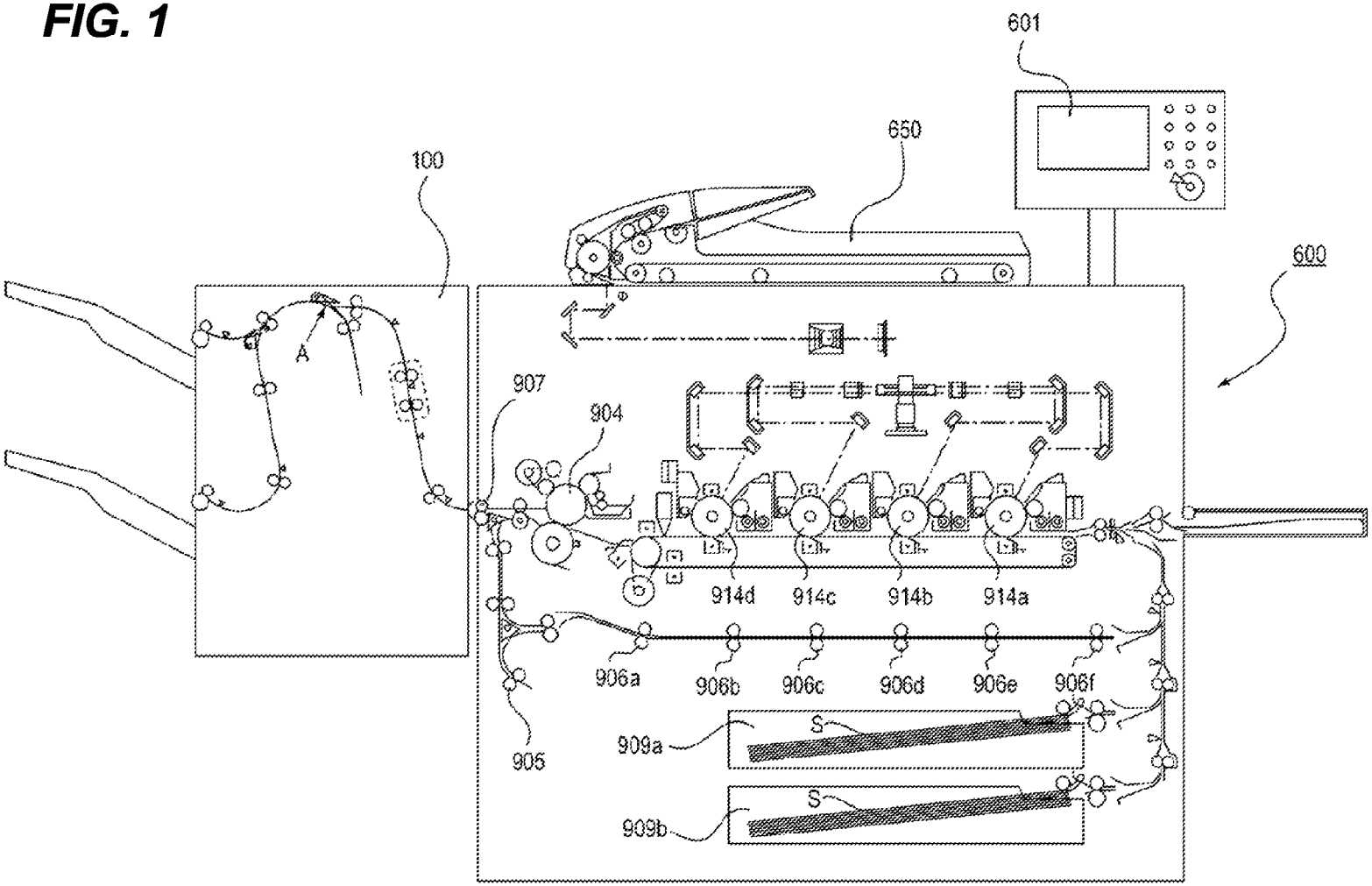
FIG. 1 is a schematic sectional view illustrating structures of a sheet processing apparatus and an image forming apparatus.

(Image Forming Apparatus) FIG. 1 is a block diagram of the image forming apparatus and the sheet processing apparatus. As illustrated in FIG. 1, the image forming apparatus includes an image forming apparatus main body 600 for performing monochrome/color image forming and a sheet stacker 100 as a sheet processing apparatus connected to the image forming apparatus main body 600 in a detachably attachable manner. Therefore, a large number of sheets discharged from the image forming apparatus main body 600 can be stacked in the sheet stacker 100 connected online.

The image forming apparatus main body 600 can also be used alone without the sheet stacker 100 connected to its discharge port. Besides the sheet stacker 100, a sheet processing apparatus having a processing portion such as a stapler to be able to perform side binding and saddle binding processes may be connected to the image forming apparatus to perform processes from image forming to various binding processes in a sequential flow. The image forming apparatus main body 600 may integrally include the sheet stacker 100 as the sheet processing apparatus.

Here, a position where a user faces an operation portion 601 for performing various inputs/settings for the image forming apparatus main body 600 is referred to as a front forward side (hereafter, forward side) of the image forming apparatus and a back side of the apparatus which is on an opposite side from the forward side is referred to as a back side. FIG. 1 is the schematic sectional view illustrating the structure of the image forming apparatus seen from the apparatus forward side. The sheet stacker 100 is connected to a side portion of a discharge port side of the image forming apparatus main body 600.

A four-color toner image is transferred onto a sheet S fed from a cassette 909*a* or 909*b* in the image forming apparatus main body 600 by photosensitive drums 914*a* to 914*d* of yellow, magenta, cyan, and black respectively forming image forming portions. Then, the sheet S is conveyed to a fixing device 904, where the toner image is fixed, and is discharged as it is to an outside of the apparatus main body by a pair of discharge rollers 907 in a single-side image forming mode.

In a both-side image forming mode, the sheet S is handed from the fixing device 904 to a reversing roller 905, where front and back sides are reversed, and is conveyed toward both-side conveying rollers 906*a* to 906*f*. Then, onto the back side, a four-color toner image is transferred again by the photosensitive drums 914*a* to 914*d* of yellow, magenta, cyan, and black. The sheet S on both sides of which the images are transferred is transferred to the fixing device 904 again, where the toner image is fixed, and is discharged to the outside of the apparatus main body by the pair of discharge rollers 907.

Figure 2A:
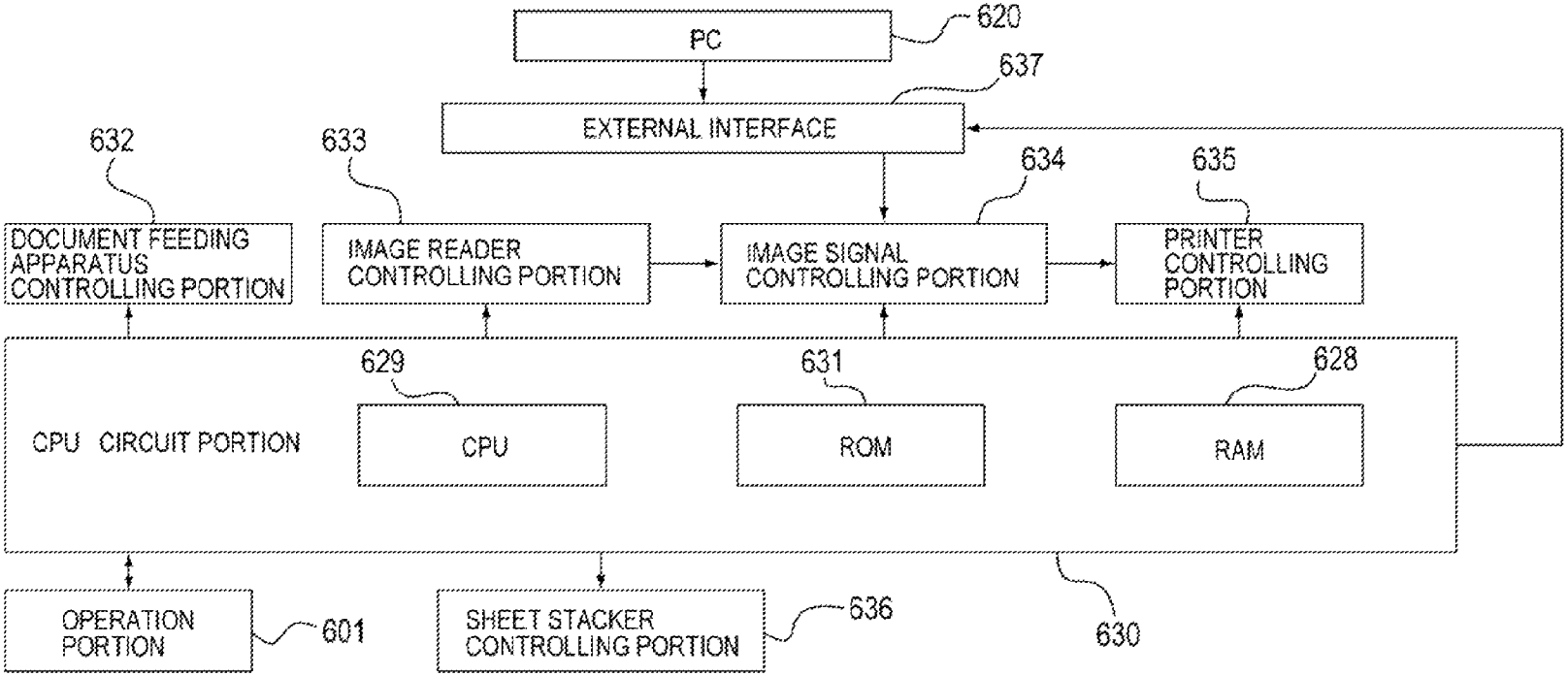
FIGS. 2A and 2B are block diagrams of controlling portions of the image forming apparatus and the sheet processing apparatus.

FIG. 2A is a block diagram of an image forming apparatus controlling portion for controlling the image forming apparatus. As illustrated in FIG. 2A, a CPU circuit portion 630 includes a CPU 629, a ROM 631, and RAM 628. The CPU circuit portion 630 controls a document feeding apparatus controlling portion 632, an image reader controlling portion 633, an image signal controlling portion 634, a printer controlling portion 635, a sheet stacker controlling portion 636, and an external interface 637. The CPU circuit portion 630 controls operation of the entire apparatus according to programs stored in the ROM 631 and the setting of the operation portion 601.

The document feeding apparatus controlling portion 632 controls a document feeding apparatus 650 (see FIG. 1) for feeding a document to an image reader provided on an upper portion of the image forming apparatus main body 600. The image reader controlling portion 633 controls the image reader. The printer controlling portion 635 controls the image forming apparatus main body 600. The sheet stacker controlling portion 636 controls the sheet stacker 100.

Here, a structure in which the sheet stacker controlling portion (controlling portion) 636 is mounted to the sheet stacker 100 will be described. However, the invention is not limited to this structure. Instead, the sheet stacker controlling portion 636 may be provided to the image forming apparatus main body 600 integrally with the CPU circuit portion 630 and control the sheet stacker 100 from the image forming apparatus main body 600.

The RAM 628 is used as an area for temporarily storing control data and as a work area for computation involved with control. The external interface 637 is an interface from a computer (PC) 620 and develops printing data into an image and outputs it to the image signal controlling portion 634. The image reader controlling portion 633 outputs an image read by the image reader to the image signal controlling portion 634 and the image output from the image signal controlling portion 634 to the printer controlling portion 635 is input to an exposure controlling portion.

Figure 3A:
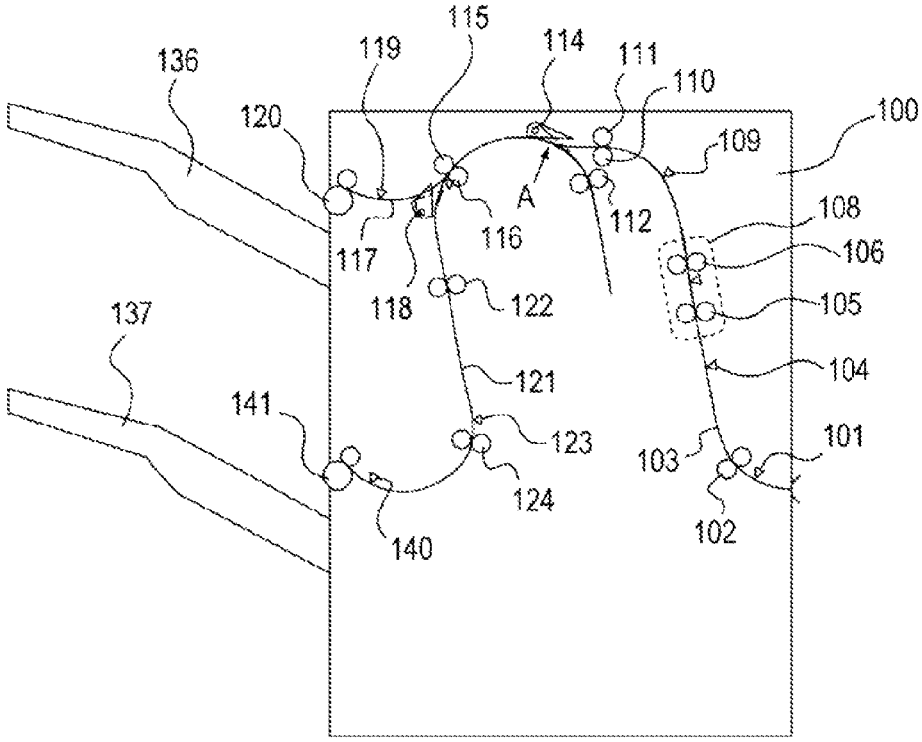
FIG. 3A is a schematic sectional view of the structure of the sheet processing apparatus and FIG. 3B is a sectional view of a driving structure of a buffer conveying portion in the sheet processing apparatus.

(Sheet Processing Apparatus) FIG. 3A is a schematic sectional view of the structure of the sheet stacker 100 as the sheet processing apparatus. As illustrated in FIG. 3A, the sheet stacker 100 includes a shift unit 108 as a sheet sorting portion, a buffering processing portion as a sheet conveying apparatus (sheet buffering processing portion) and a stack tray (discharge tray) as a stacking portion. The sheet S discharged from the image forming apparatus main body 600 is handed to a pair of inlet rollers 102 of the sheet stacker 100. At this time, handing timing of the sheet is sensed at the same time by an inlet sensor 101. While the sheet S conveyed by the pair of inlet rollers 102 passes through a conveying path 103, an end portion position of the sheet S in a width direction orthogonal to a conveying direction of the sheet is sensed by an end portion sensor 104. In this way, an amount of a width-direction error (positional displacement) with respect to a conveying center position of the sheet stacker in the width direction is sensed.

After the error in the sheet width direction is sensed, shifting operation of the sheet S is performed by moving the shift unit 108 in the forward/backward direction (the sheet width direction) by a predetermined amount while the sheet S is conveyed by pairs of shift rollers 105 and 106. In other words, by moving the shift unit 108 in the sheet width direction by the predetermined amount, the positional displacement of the sheet in the width direction is corrected.

Then, the sheet S conveyed by a pair of pre-buffer conveying rollers 110 and 111 is conveyed by a pair of buffer conveying rollers 115 which is a conveying portion and can be rotated normally and reversely. Then, if the sheet S is discharged to an upper discharge tray 136 which is a stacking portion, an upper path switch member 118 is brought into a state illustrated in a broken line in the drawing by a drive portion (not illustrated) such as a solenoid to guide the sheet S into an upper path conveying path 117 and the sheet S is discharged to the upper discharge tray 136 by a pair of upper discharge rollers 120.

If the sheet S is not discharged to the upper discharge tray 136, the sheet S conveyed by the pair of buffer conveying rollers 115 is guided into a lower conveying path 121 by the upper path switch member 118. Then, the sheet S is discharged to a lower discharge tray 137 which is a stacking portion by a pair of lower discharge rollers 141 via a pair of first lower conveying rollers 122 and a pair of second lower conveying rollers 124. An upper discharge sensor 119, a lower conveying sensor 123, and a lower discharge sensor 140 form detecting portions for detecting a front end and a rear end of the sheet in the conveying paths and detecting conveying timing. If these detecting portions do not detect the sheet end portions after prescribed timing, the operation portion 601 displays a signal indicating that the sheet is staying in the apparatus.

Figure 4:
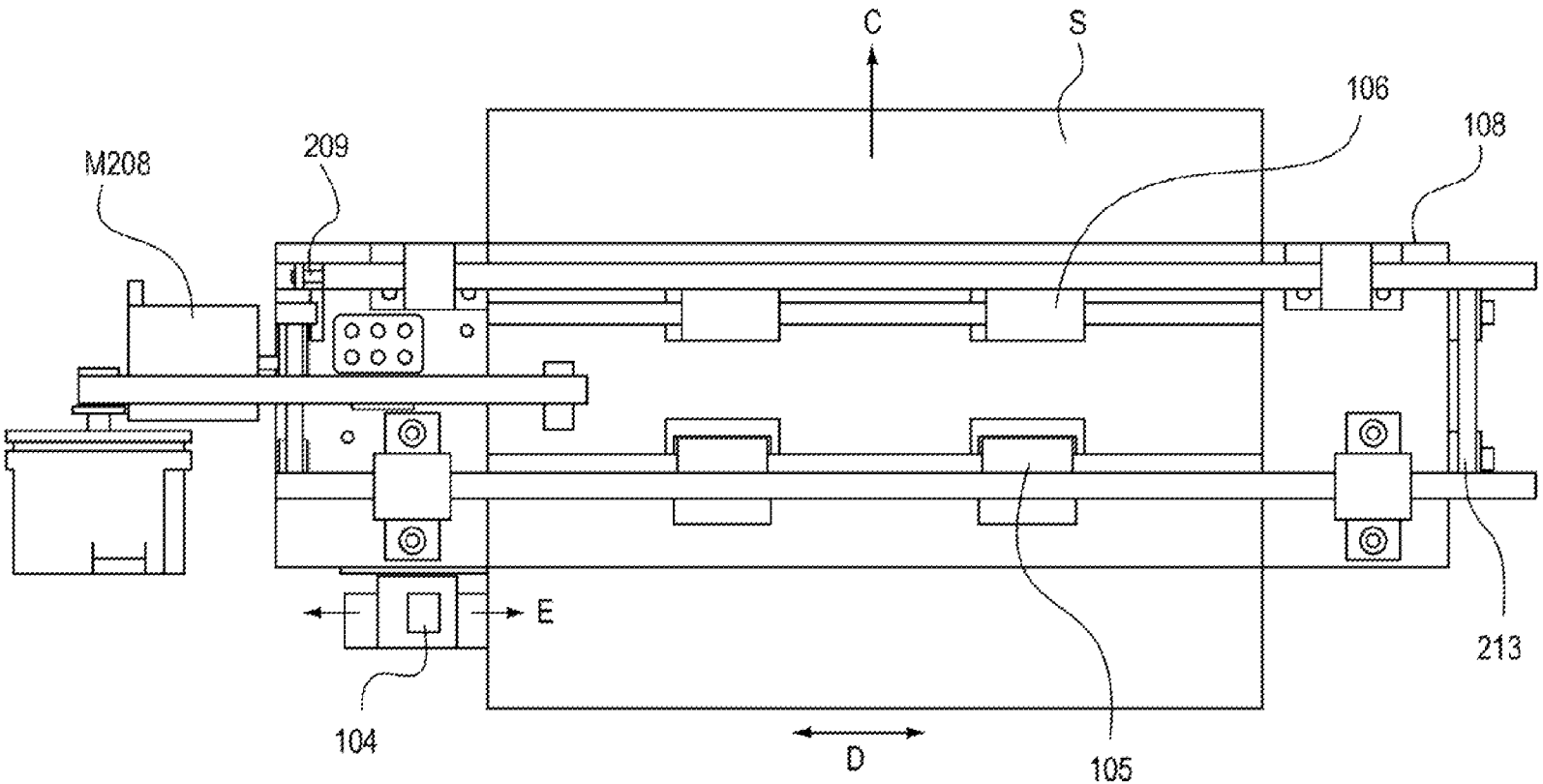
FIG. 4 is a front view of a shift unit.

<Description of the Shift Unit> Next, a structure and operation of the shift unit 108 will be described by using a front view in FIG. 4. The conveyed sheet S is conveyed in a direction of an arrow C in the drawing when drive of a shift conveying motor M208 is transmitted through a drive belt 209 to drive the pair of shift rollers 106 and a drive belt 213 drives the pair of shift rollers 105. At this time, the end portion sensor 104 is moved in a direction of arrows E by a drive portion (not illustrated) to thereby detect a conveying position of the sheet S (a lateral registration error X which is a positional displacement amount in the width direction). The sheet is moved by a shift amount Z ($Z=X+\alpha$) of the sheet which is the sum of the lateral registration error X and the shift amount $\alpha$ of the sheet while the sheet is conveyed. By performing this operation in the forward/backward direction (directions of arrows) when the sheet S is nipped between the pairs of shift rollers 105 and 106, it is possible to move (shift) the sheet S in the width direction (directions of the arrows D) by the predetermined amount while conveying the sheet S in the conveying direction (direction of the arrow C).

Figure 2B:
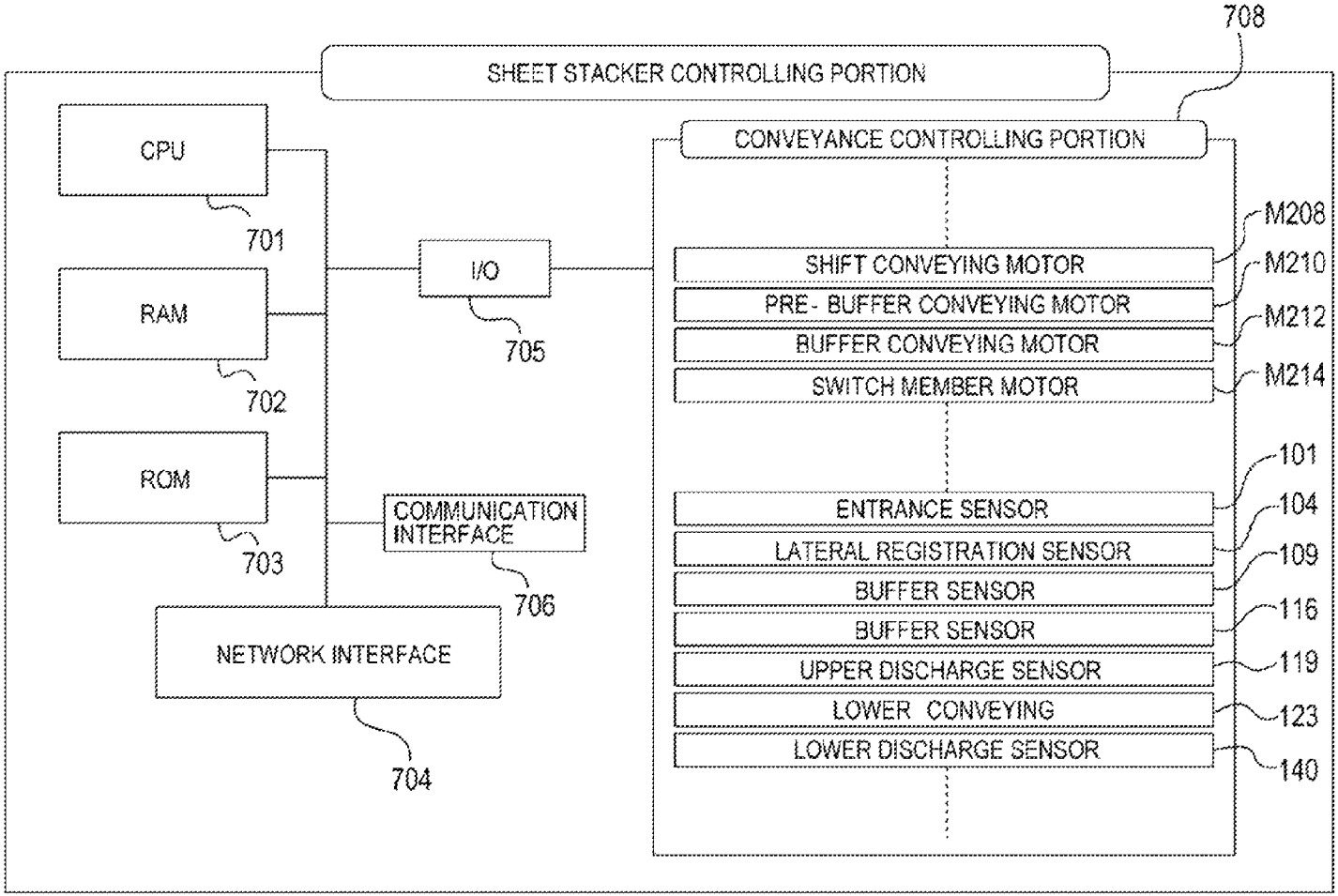
Figure 3B:
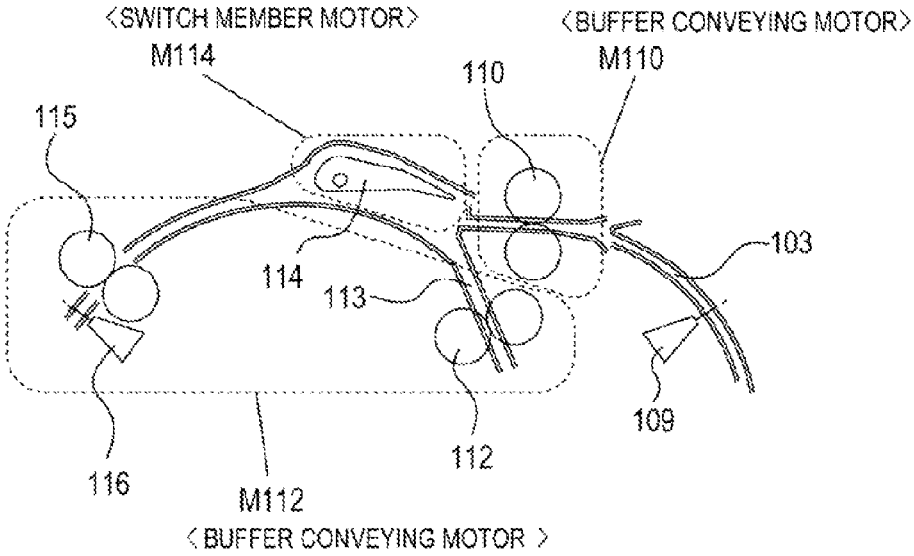
Figure 5A:
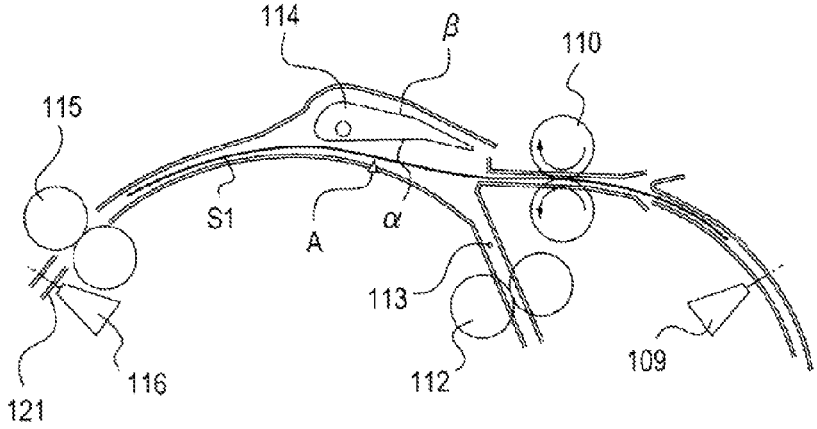
FIGS. 5A, 5B, and 5C are sectional views of an essential portion and for describing operation of the sheet processing apparatus according to a first embodiment.
Figure 5B:
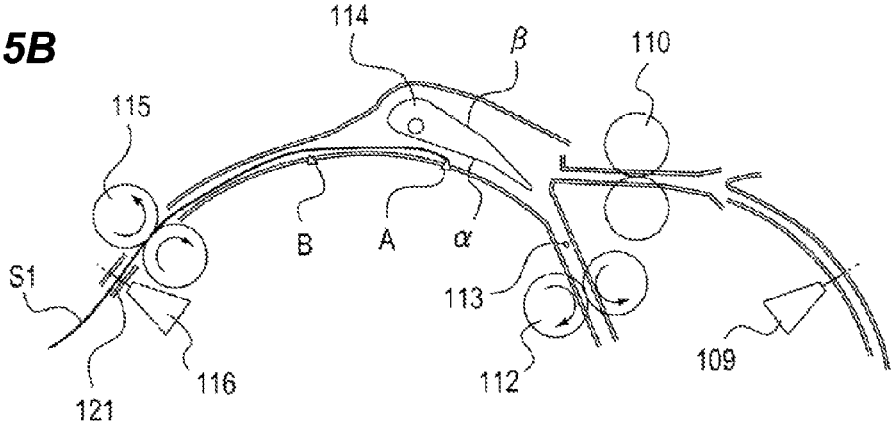
Figure 5C:
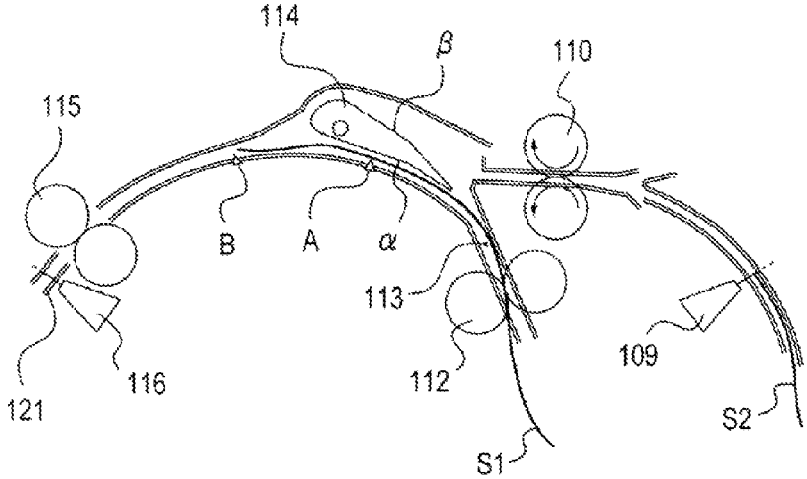
Figure 6A:
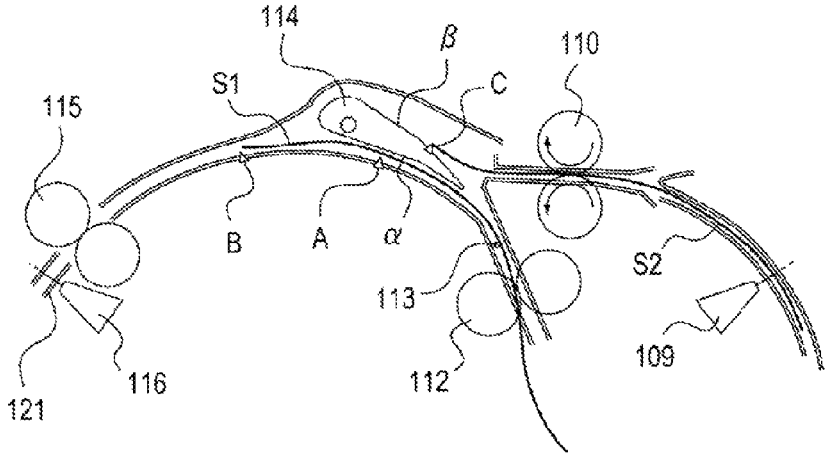
FIGS. 6A, 6B, and 6C are sectional views of the essential portion and for describing operation of the sheet processing apparatus according to the first embodiment.
Figure 6B:
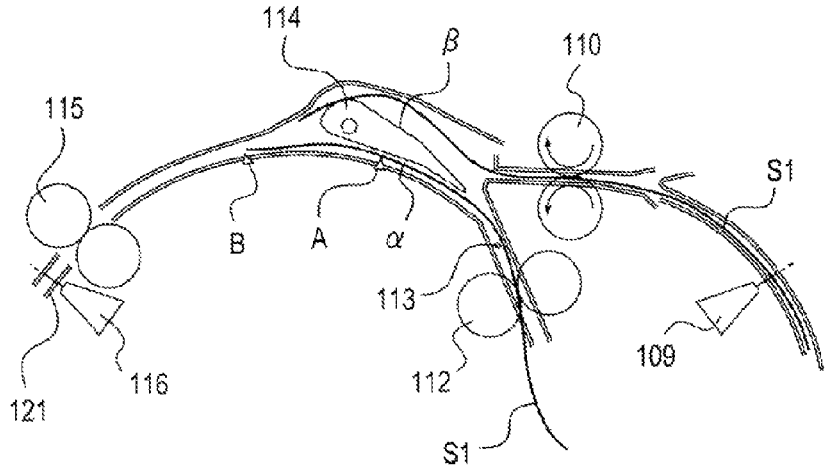
Figure 6C:
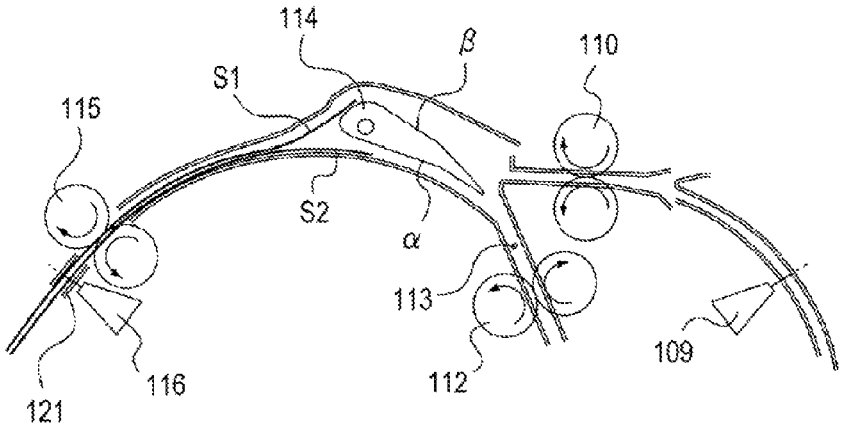
Figure 7:
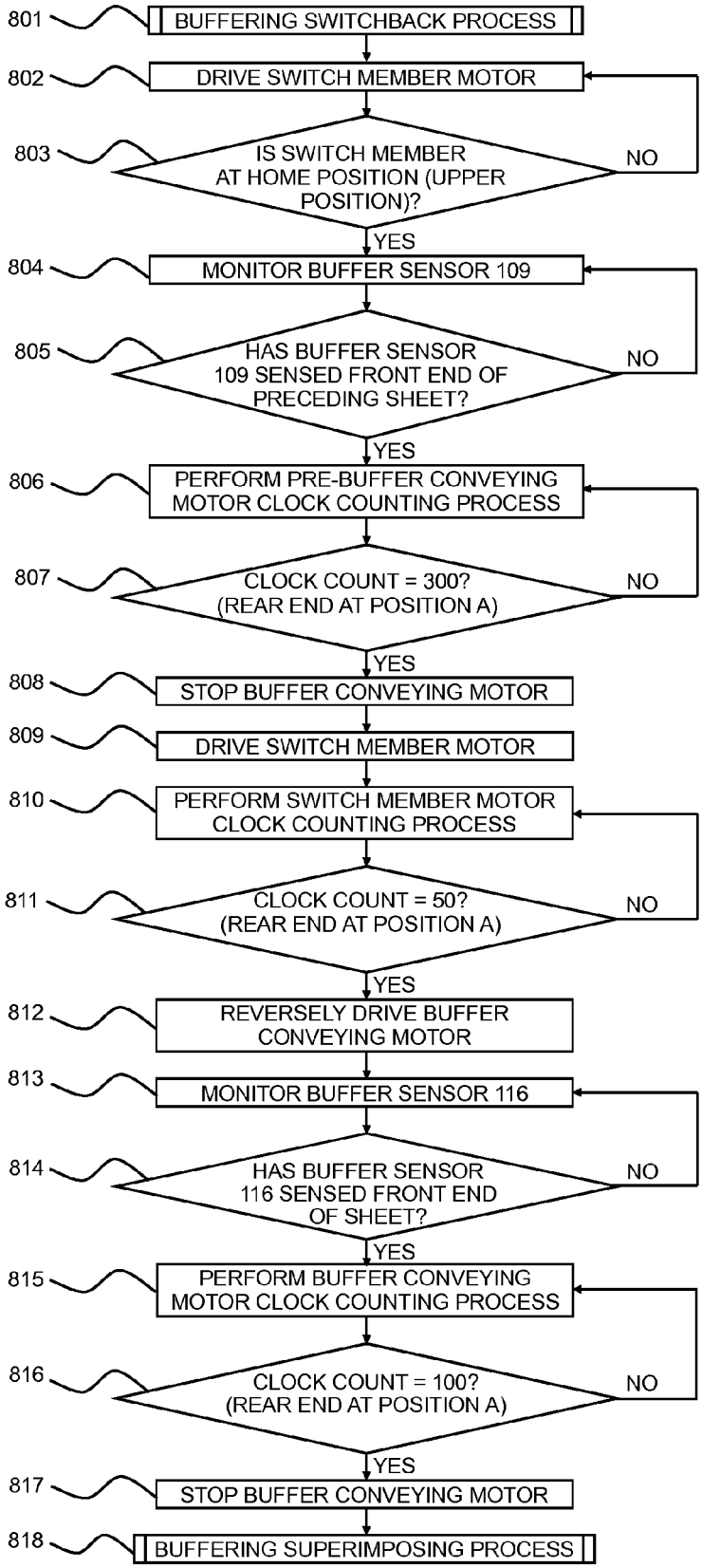
FIG. 7 is a flowchart for describing the operation of the sheet processing apparatus according to the first embodiment.
Figure 8:
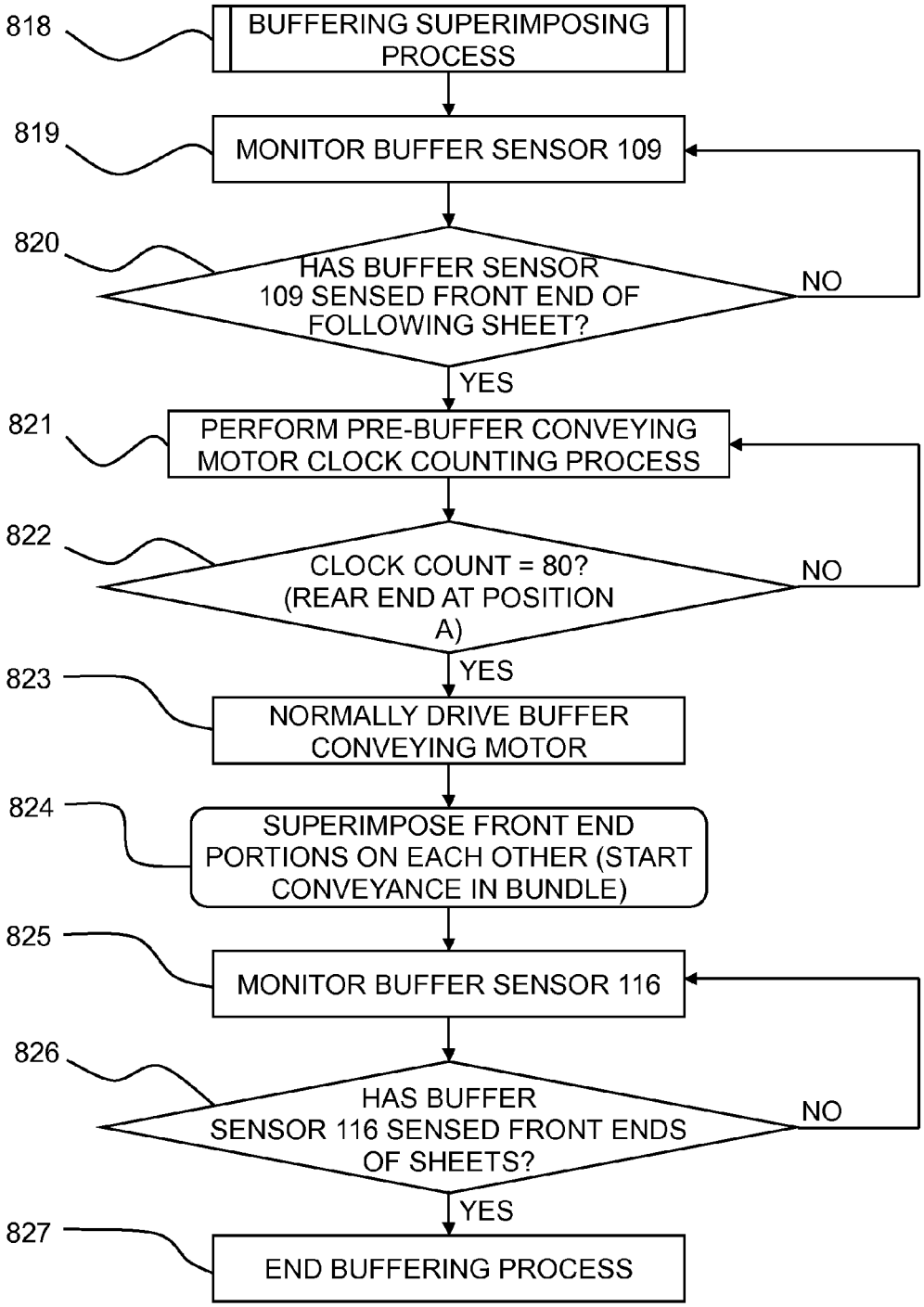
FIG. 8 is a flowchart for describing the operation of the sheet processing apparatus according to the first embodiment.

<Description of Buffering Processing Operation> Next, by using FIGS. 2B, 3B and 5A to 8, a structure related to the buffering processing portion and sheet conveying operation will be described. FIG. 2B is a block diagram illustrating a detail of a conveyance controlling portion 708 of the sheet stacker controlling portion 636. FIG. 3B is a drive block diagram of the buffering processing portion. FIGS. 5A to 6C are operation drawings illustrating the buffering processing operation. FIGS. 7 and 8 are flowcharts illustrating the buffering processing operation.

The buffering process is a process for sequentially superimposing the sheets S, which have been conveyed one by one, into a sheet bundle including a plurality of sheets in the conveying path in the apparatus. By performing the buffering process, there are roughly two effects.

The first effect is to temporarily delay conveying arrival time of the sheet S at the downstream apparatus without reducing productivity to thereby secure time required for various processes such as alignment of the sheets and a binding process.

The second effect is to increase rigidity by conveying the plurality of sheets in a bundle, e.g., by superimposing the plurality of sheets on each other and conveying them in a case of thin sheets to thereby improve conveying performance of the sheets, stacking performance to the stack tray, and aligning performance.

As illustrated in FIG. 2B, the sheet stacker controlling portion 636 includes a CPU 701, a ROM 702, RAM 703, a network interface 704, an I/O 705, and a communication interface 706. The sheet stacker controlling portion 636 controls the conveyance controlling portion 708 through the I/O 705. The conveyance controlling portion 708 includes respective motors M110, M112, M114, and M208 and respective sensors 101, 104, 109, 116, 119, 123, and 140. The conveyance controlling portion 708 controls operations of the respective motors according to signals of the respective sensors.

As illustrated in FIG. 3B, the buffering processing portion includes the pair of pre-buffer conveying rollers 110 driven for rotation by the pre-buffer conveying motor M110. The buffering processing portion also includes a pair of first buffer conveying rollers 112 and a pair of second buffer conveying rollers 115 as the conveying portion driven for normal and reverse rotations by the buffer conveying motor M112. The buffering processing portion also includes the conveying path 103 as a common conveying route for guiding the sheet and a buffer path 113 as a reverse conveying route branching off from a midway point of the conveying path 103 to guide the sheet. Furthermore, in order to guide the sheet S into the buffer path 113, the buffering processing portion also includes a switch member 114 to be driven by the switch member motor M114 and the first buffer sensor 109 and the second buffer sensor 116 as the sheet detectors for sensing the end portion of the conveyed sheet S. The buffering processing portion is made up of these members.

The conveying path 103 is the common conveying route for guiding the sheet toward the discharge tray (stacking portion) to be stacked with the sheets. The buffer path 113 is the reverse conveying route branching off from the midpoint of the conveying path 103 to guide the sheet in an opposite direction from the discharge tray.

The pairs of conveying rollers 112 and 115 are the conveying portion for conveying the sheet S toward the discharge tray or in the opposite direction from the discharge tray in the conveying path 103 and the buffer path 113.

The switch member 114 is provided at a branch portion between the conveying path 103 and the buffer path 113. The switch member 114 can be switched between a first position and a second position. The switch member 114 guides the sheet from an upstream side of the branch portion toward the discharge tray at the first position (upper position) and guides the sheet from the downstream side of the branch portion toward the buffer path 113 at the second position (lower position). The switch member 114 has a first guide face $\alpha$ for guiding the sheet and a second guide face $\beta$ opposed to the first guide face $\alpha$.

By using operation sectional views in FIGS. 5A to 6C and flowcharts in FIGS. 7 and 8, flows of the sheets at the time of the buffering operation will be described below.

The conveyed preceding sheet S1 is subjected to a switchback process (S801) for buffering. First, the switch member 114 waits at the upper position which is a home position illustrated in FIG. 5A until the sheet S1 arrives (S802, S803). The preceding sheet S1 is guided by the first guide face $\alpha$ of the switch member 114 at the upper position and conveyed in a first direction toward the lower conveying path 121 by the pair of pre-buffer conveying rollers 110 and the pair of second buffer conveying rollers 115. At this time, a front end (downstream end in the conveying direction) of the sheet S1 is sensed by the second buffer sensor 116 (S804, S805). Then, a stop control of the pair of second buffer conveying rollers 115 is performed so that the sheet S1 stops when a rear end (upstream end in the conveying direction) of the sheet S1 arrives at a position A as illustrated in FIG. 5B based on information of a size of the sheet in the conveying direction and recognized in advance (S806 to S808). Here, when a clock count has reached 300 since the front end of the sheet S1 was sensed, the rear end of the sheet S1 arrives at the position A and the buffer conveying motor M112 is stopped.

When the rear end of the sheet S1 arrives at the position A, the switch member motor M114 moves the switch member 114 to the lower position illustrated in FIG. 5B for guiding the sheet toward the buffer path 113. Furthermore, the pair of second buffer conveying rollers 115 starts reverse conveyance in a second direction opposed to the first direction. As a result, the sheet S1 is guided by the first guide face α of the switch member 114 at the lower position and the rear end portion of the sheet S1 is guided into the buffer path 113 as illustrated in FIG. 5C. Then, the sheet S1 is reversely conveyed by the pair of second buffer conveying rollers 115 until the front end of the sheet S1 arrives at the position B and the stop control is performed (S809 to S817). In this way, the sheet S1 is made to wait in the buffer path 113.

In other words, in the switchback process for the buffering, the preceding sheet S1 conveyed toward the discharge tray is guided by the first guide face α of the switch member 114 at the upper position. After the rear end of the preceding sheet S1 passes through the branch portion, the switch member 114 is switched to the lower position. Then, the preceding sheet S1 conveyed from the downstream side of the branch portion toward the buffer path 113 is guided by the first guide face α of the switch member 114 at the lower position and is made to wait in the buffer path 113.

Next, the operation goes to a buffering superimposing process (S818). First, a front end of a conveyed following sheet S2 is sensed by the first buffer sensor 109 (S819 to S820). Then, when the front end of the sheet S2 arrives at a position C illustrated in FIG. 6A, the pair of first buffer conveying rollers 112 is activated to start acceleration at a predetermined time so that the front ends of the sheet S1 stopped in the buffer path 113 and the sheet S2 are aligned with each other (S821 to S823).

The switch member 114 waits for arrival of the following sheet S2 conveyed by the pair of pre-buffer conveying rollers 110 while maintained at the lower position for guiding the preceding sheet S1 toward the buffer path 113. As illustrated in FIG. 6B, the sheet S2 is conveyed toward the pair of second buffer conveying rollers 115 while guided by the second guide face β of the switch member 114 at the lower position. Then, the following sheet S2 is conveyed side by side with the preceding sheet S which has started accelerating at a predetermined time in advance and meets the sheet S1 at a downstream portion of the switch member 114 so that front ends of the sheets are aligned with each other (S824).

Because the preceding sheet S1 starts to be conveyed toward the downstream side of a front end position B before meeting the following sheet S2, a meeting position of the front ends of the following sheet S2 and the waiting preceding sheet S1 is positioned downstream of the front end position B of the preceding sheet S waiting in the buffer path 113. In the conveying route between the switch member 114 and the meeting position of the sheets, the pair of conveying rollers is not disposed.

After the sheet S1 and the sheet S2 meet at the downstream portion of the switch member 114, acceleration of the sheet S1 ends and the sheet S1 is conveyed at the same velocity as the sheet S2. Then, as illustrated in FIG. 6C, the sheet S1 and the sheet S2 are nipped by the pair of buffer conveying rollers 115 with their front ends aligned with each other, the front ends pass the second buffer sensor 116, and the sheets are discharged to the upper discharge tray 136 or the lower discharge tray 137 on the downstream side (S827).

In other words, in the buffering superimposing process, while the switch member 114 is maintained at the lower position, the following sheet S2 conveyed from the upstream side of the branch portion toward the discharge tray is guided by the second guide face β of the switch member 114 at the lower position. Then, the sheet S2 meets the waiting sheet on the downstream side of the switch member 114 and the sheets are conveyed in the sheet bundle toward the discharge tray.

Because the sheet S1 and the sheet S2 respectively pass the first guide face α and the second guide face β of the switch member 114 maintained at the lower position, the switch member 114 need not be switched and buffering is possible even if a sheet interval between the sheet S1 and the sheet S2 is small. Moreover, the sheets are put together into the bundle of two sheets in the buffering processing portion and are discharged to the upper discharge tray 136 or the lower discharge tray 137. As a result, as described above, even thin sheets having insufficient stiffness can be put together into a bundle of sheets to obtain certain or more stiffness and can be discharged stably without impairing the stacking performance.

In a case of a sheet not requiring the buffering process, the switch member 114 is moved to and maintained at the upper position for guiding the sheet from the pre-buffer conveying rollers 110 toward the lower conveying path 121. Then, after the sheet S discharged from the image forming apparatus main body 600 is moved in advance to a predetermined sorting position in the shift unit 108, the sheet is discharged one by one to the upper discharge tray 136 or the lower discharge tray 137 without being subjected to the buffering process.

Figure 9:
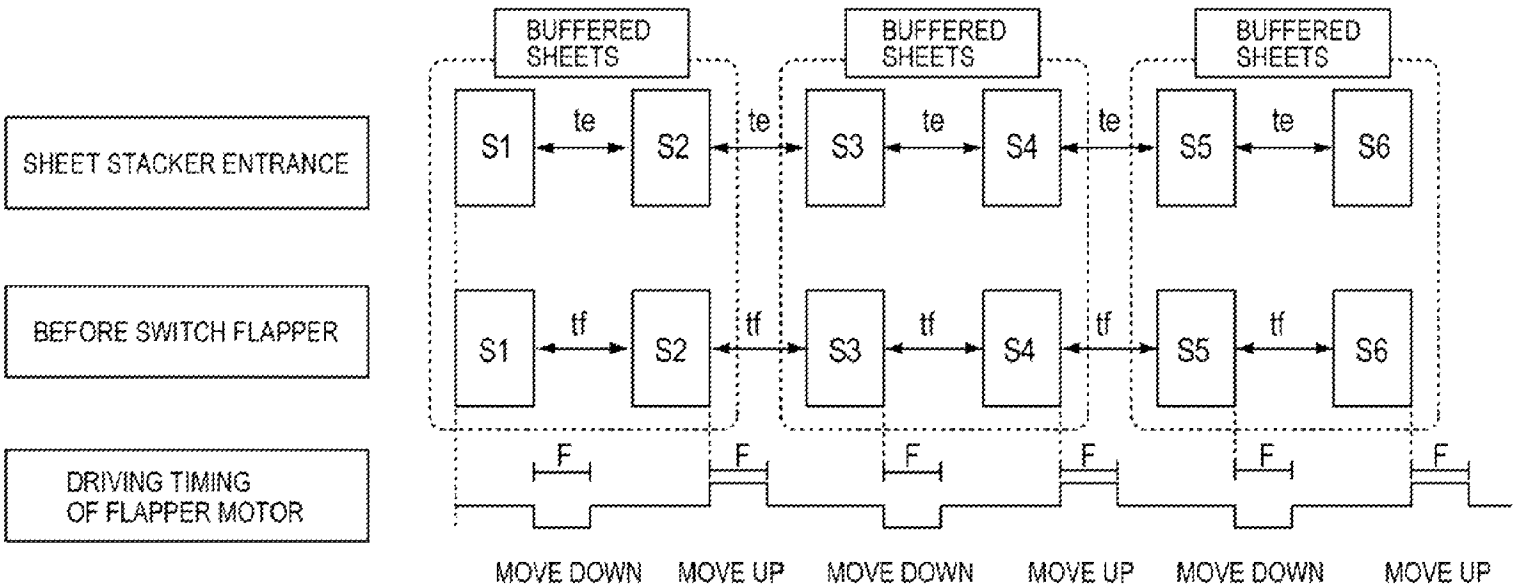
FIG. 9 is an explanatory view for describing control timing of the sheet processing apparatus according to the first embodiment.

FIG. 9 is a drawing illustrating a timing chart of the buffering processing portion. A sheet conveying interval t of the sheets in the sheet stacker 100 is determined by the production number of sheets P per unit time from the image forming apparatus main body 600 which is the apparatus connected on the upstream, a conveying velocity V, and a sheet size L (length in the conveying direction). A conveying interval to of the sheets at the inlet portion of the sheet stacker 100 is the same as a conveying interval tf of the sheets at the pair of pre-buffer conveying rollers 110 before the switch member 114, if the conveying velocity V is constant. If the buffering process for two sheets at a time is performed in the sheet stacker 100 in the embodiment, the switch member motor M114 may be driven and either one of upward and downward moving operations F of the switch member 114 may be completed during the conveying interval tf as illustrated in FIG. 9. Therefore, even if the conveying interval tf is short because the production number of sheets P increases or the conveying velocity V is set to be low, there is no issue, if the conveying interval tf is not shorter than a moving operation time F of the switch member motor M114. As a result, it is possible to adapt to increase in the production number of sheets P and low-velocity conveyance.

As described above, according to the embodiment, it is possible to make the following sheet to meet the waiting sheet while maintaining the position of the switch member. Therefore, as compared with the prior-art apparatus in which the switch member is reciprocated, a processing velocity for bundling and conveying the sheets increases. Therefore, it is possible to further increase productivity and the apparatus in the embodiment can adapt to the highly productive apparatus.

Even in the case of the highly productive apparatus, it is possible to bundle and convey thin sheets with relatively low stiffness to thereby further improve the conveying performance and the stacking performance. Moreover, it is possible to reduce operating time of the apparatus and power consumption.

Second Embodiment

Figure 10:
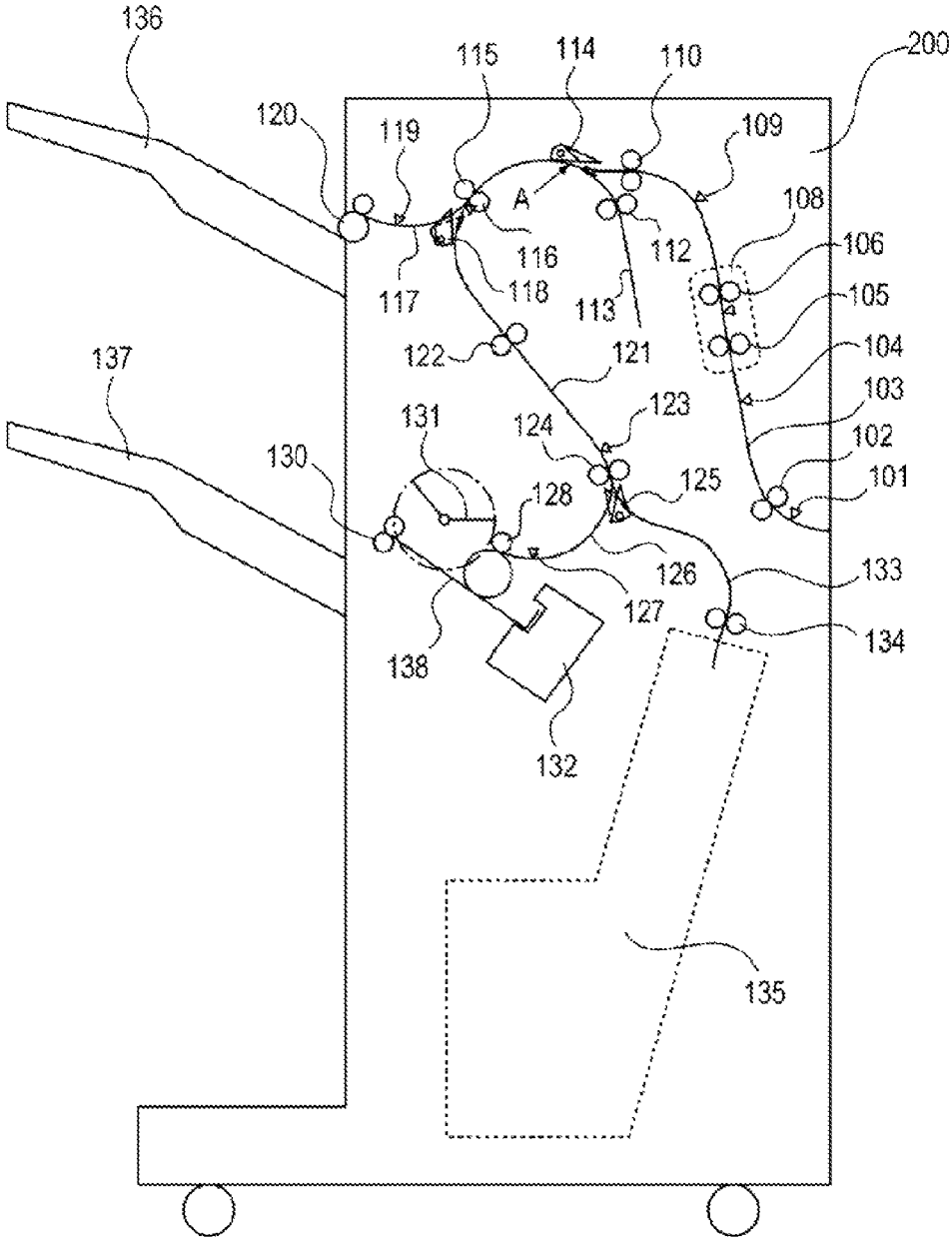
FIG. 10 is a schematic sectional view of a structure of a sheet processing apparatus according to a second embodiment.

Next, a second embodiment will be described. FIG. 10 is a sectional view of a finisher 200 having a buffering processing portion in a conveying route. Similarly to the sheet stacker 100, the finisher 200 is a sheet processing apparatus which can be connected to the discharge portion of the image forming apparatus main body 600 and which performs processes for the sheets from the image forming apparatus main body 600.

As illustrated in FIG. 10, the finisher 200 includes a stapler (binding portion) 132 for binding the sheets as a processing portion for processing the sheets. Furthermore, the finisher 200 includes a pair of lower discharge rollers 128 as a discharge portion, a draw-in paddle 131 as a butting portion, and a processing tray 138 as a stacking portion. A structure of the apparatus is obtained by adding a sheet processing portion for binding and saddle binding processes to the lower discharge portion of the above-described sheet stacker 100. Because a sheet conveying operation and a control in discharging the sheets to the upper discharge tray 136 are similar to those of the sheet stacker 100, they will not be described.

If not discharged to an upper discharge tray 136, the sheets S conveyed by the pair of second buffer conveying rollers 115 are guided into a lower conveying path 121 by an upper path switch member 118. Then, the sheets S are sequentially conveyed through the conveying path by pairs of lower conveying rollers 122 and 124. To subject the sheets to a saddle (saddle binding) process, a drive portion (not illustrated) such as a solenoid brings a saddle switch member 125 into a state illustrated in a broke line. Then, the sheets are conveyed into a saddle path 133, guided into a saddle unit 135 by a pair of saddle inlet rollers 134, and subjected to the saddle process (saddle binding). Detailed description of a method of the saddle process will not be repeated.

To discharge the conveyed sheets S to the lower discharge tray 137, the sheets S conveyed by the pair of lower conveying rollers 124 are conveyed into a lower path 126 by the saddle switch member 125. Then, the sheets S are discharged to the processing tray 138 by the pair of lower discharge rollers 128, aligned in a bundle on the processing tray 138 or subjected to the side binding process by the stapler 132, and are discharged to the lower discharge tray 137 by the pair of discharge rollers 130 in a state of the sheet bundle.

It is known that the side binding process and the saddle (saddle binding) process usually require a certain processing time. The processing time partially depends on an image forming velocity of the image forming apparatus. However, it is usually difficult to complete the process during a sheet discharge interval and the processing time normally exceeds the sheet discharge interval. Therefore, in order to process the sheets without stopping the image forming by the image forming apparatus, a sheet buffering process is performed.

Figure 12A:
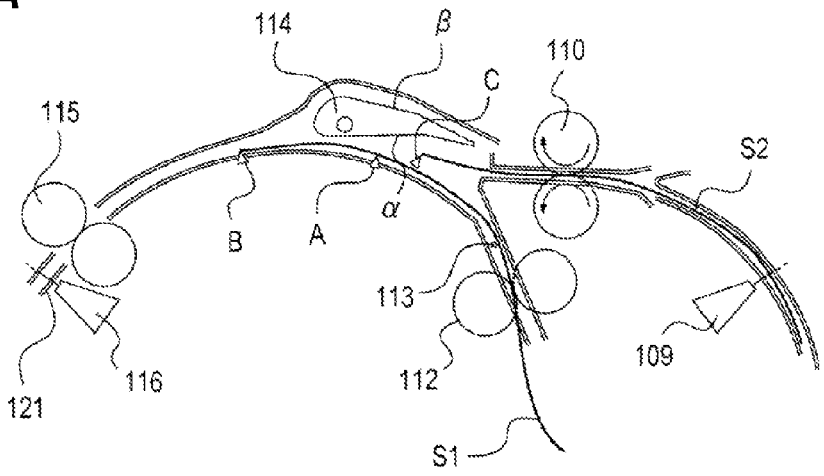
FIGS. 12A, 12B, and 12C are sectional views of the essential portion and for describing the operation of the sheet processing apparatus according to the second embodiment.
Figure 12B:
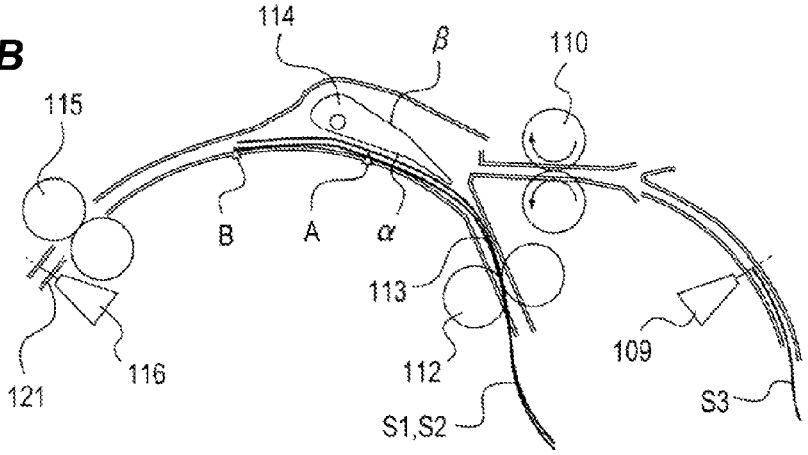
Figure 12C:
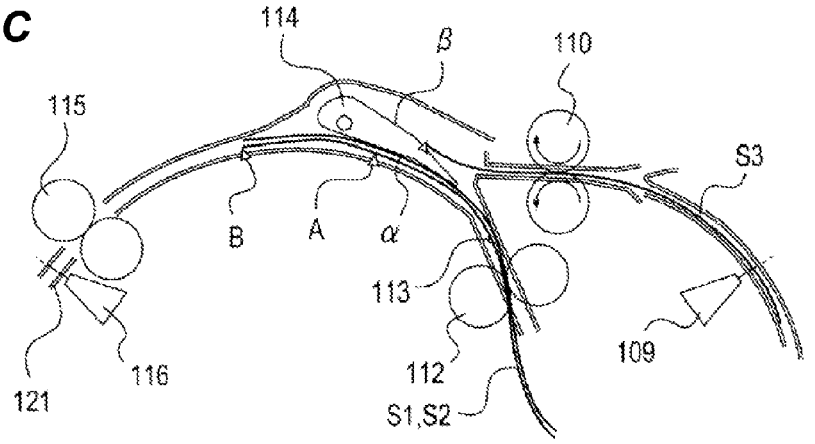
Figure 13A:
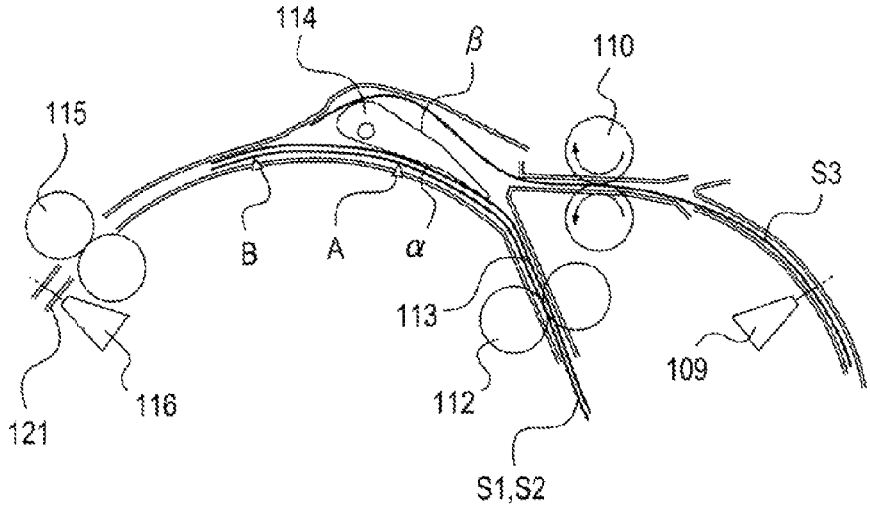
FIGS. 13A and 13B are sectional views of the essential portion and for describing the operation of the sheet processing apparatus according to the second embodiment.
Figure 13B:
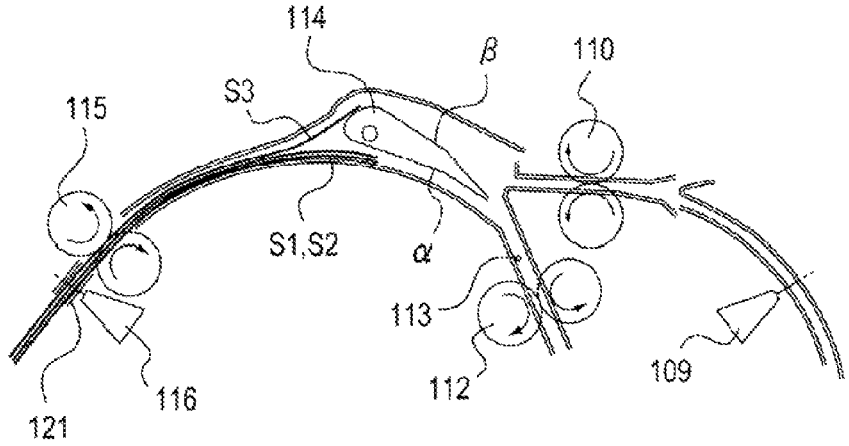
Figure 14:
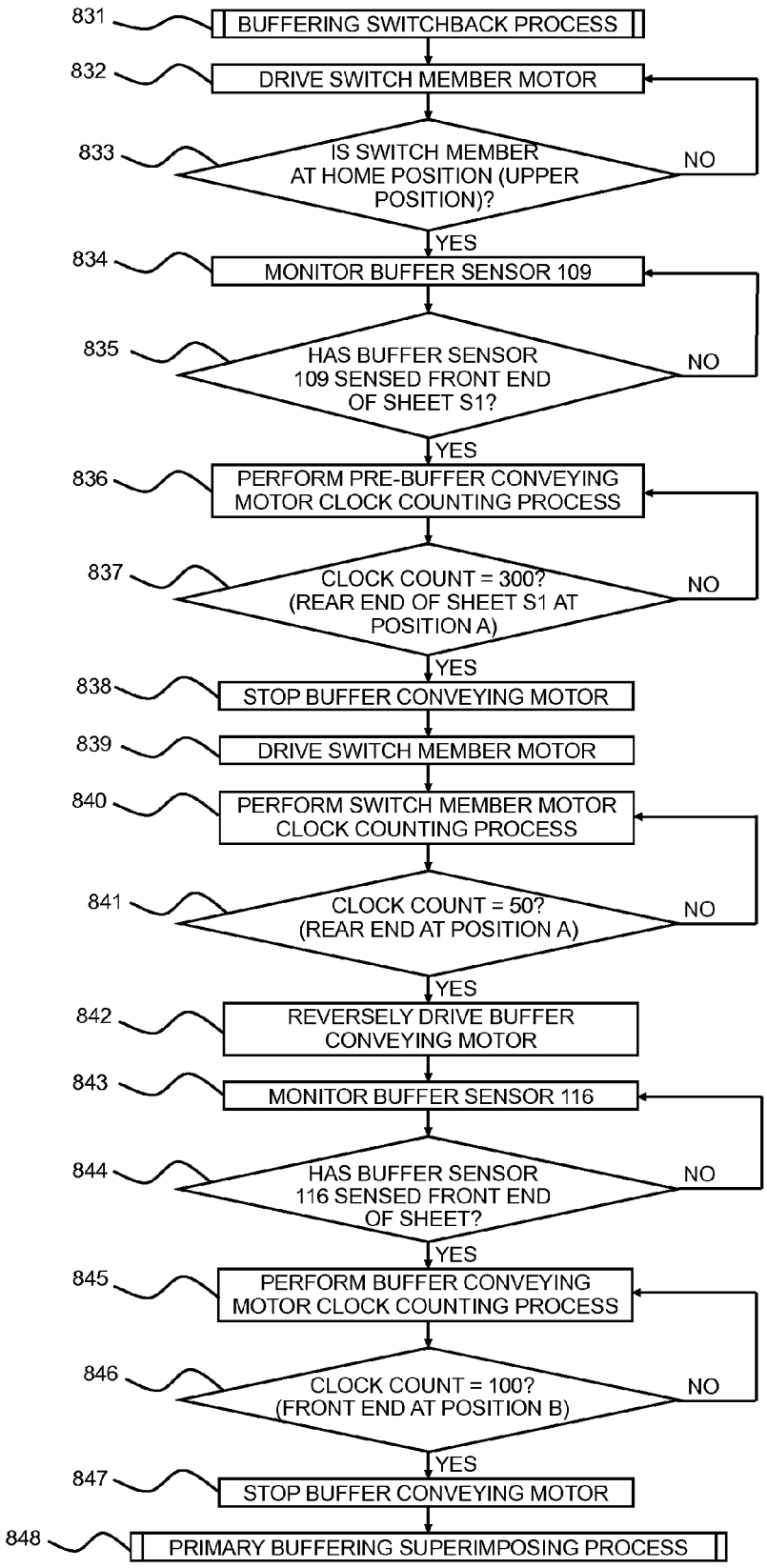
FIG. 14 is a flowchart for describing the operation of the sheet processing apparatus according to the second embodiment.
Figure 15:
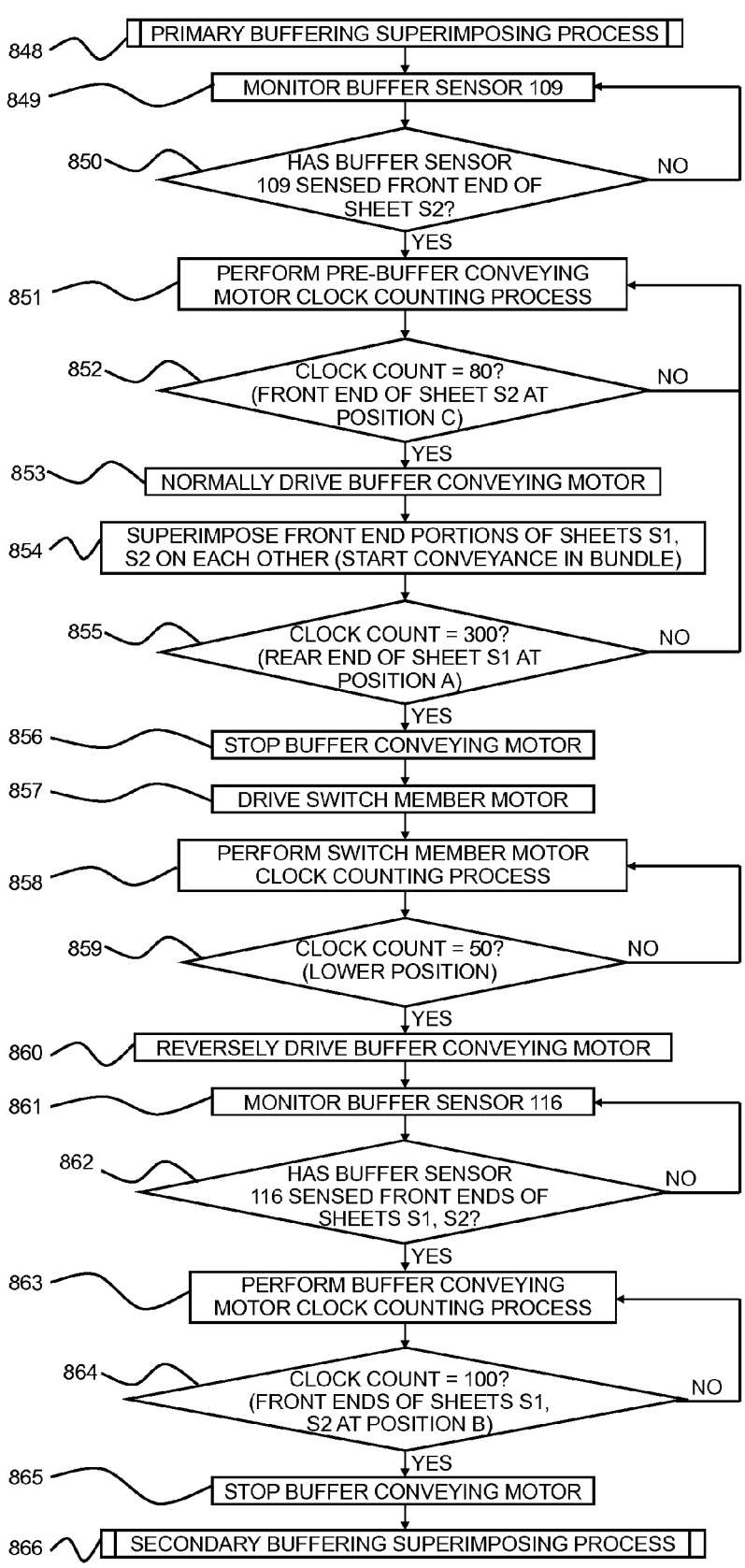
FIG. 15 is a flowchart for describing the operation of the sheet processing apparatus according to the second embodiment.
Figure 16:
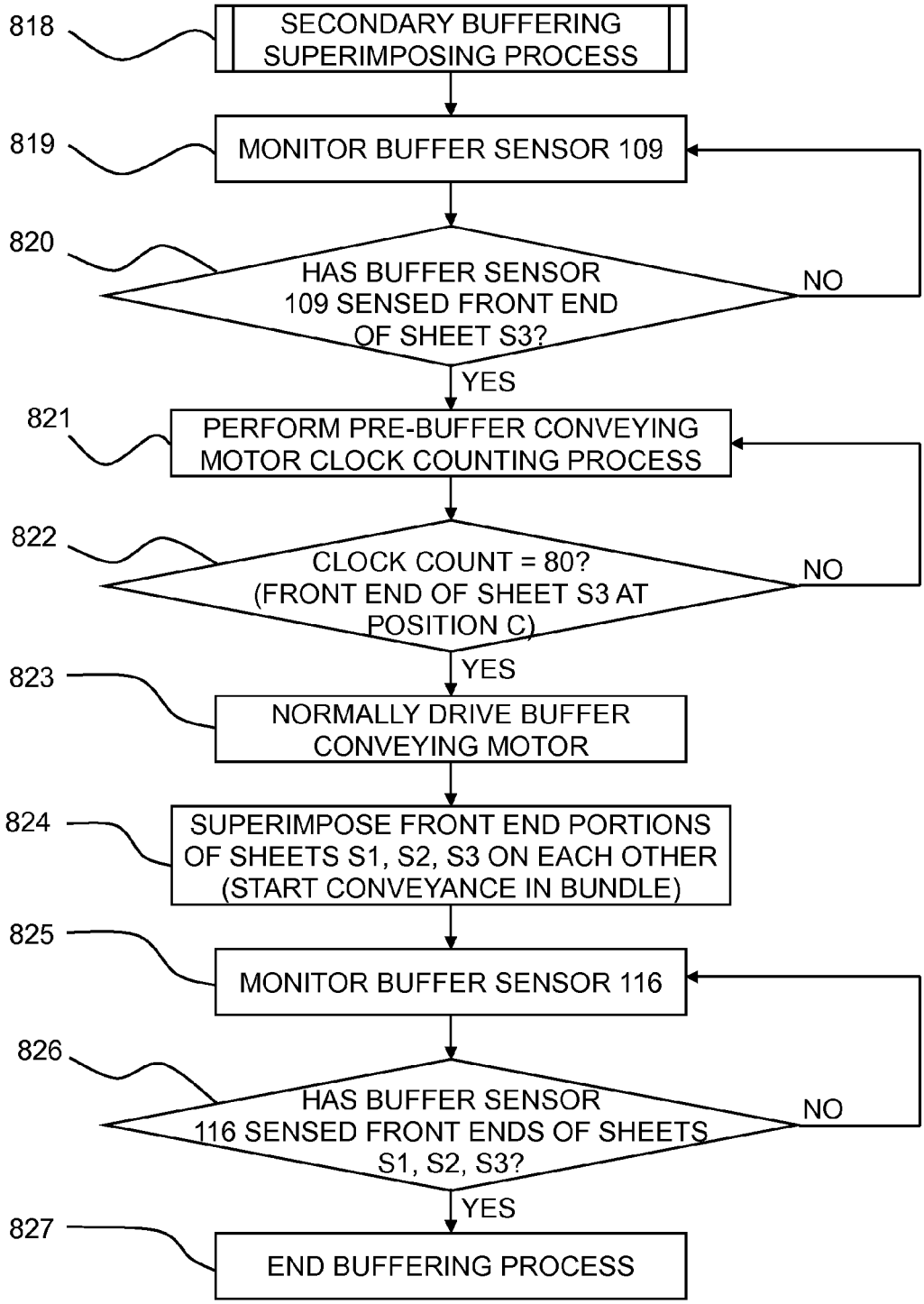
FIG. 16 is a flowchart for describing the operation of the sheet processing apparatus according to the second embodiment.

FIGS. 11A to 13B are operation sectional views illustrating a flow of sheets in performing the buffering process for three sheets S1 to S3. FIGS. 14 to 16 are flowcharts illustrating buffering processing operation of the three sheets S1 to S3. By using FIGS. 11A to 16, the flow of the sheets during the buffering process will be described. The three sheets S1, S2, and S3 are the first sheet S1, the second sheet S2, and the third sheet S3 in an order of conveyance. Here, the first sheet S1 and the second sheet S2 correspond to the first preceding sheet and the second preceding sheet sequentially waiting in a reverse conveying route and the third sheet S3 following them corresponds to the following sheet to be conveyed in the first direction toward the stacking portion together with the preceding sheets. A relationship between the preceding sheets and the following sheets is set properly according to the number of sheets to be made to wait in the reverse conveying route and is not limited to the above-described composition.

Figure 11A:
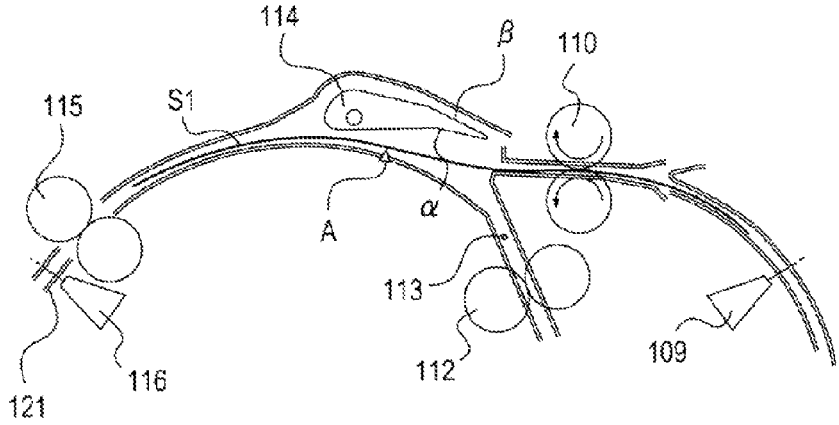
FIGS. 11A, 11B, and 11C are sectional views of an essential portion and for describing operation of the sheet processing apparatus according to the second embodiment.
Figure 11B:
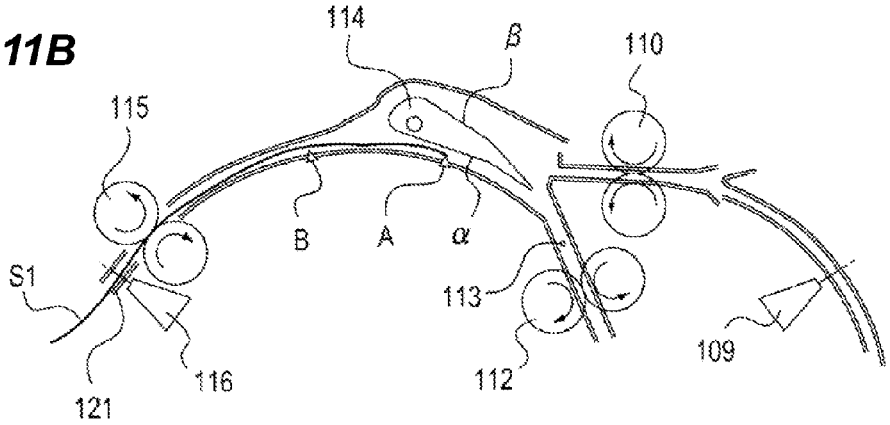

The conveyed preceding sheet S1 is subjected to a switchback process for buffering (S831) (see FIG. 14). First, the switch member 114 waits at an upper position which is a home position illustrated in FIG. 11A until the sheet S1 arrives (S832, S833). The preceding sheet S1 is guided by a first guide face α of the switch member 114 at the upper position and conveyed in the first direction toward the lower conveying path 121 by a pair of pre-buffer conveying rollers 110 and the pair of second buffer conveying rollers 115. At this time, a front end (downstream end in the conveying direction (the first direction)) of the sheet S1 is sensed by a second buffer sensor 116 (S834, S835). Then, a stop control of the pair of second buffer conveying rollers 115 is performed so that the sheet S1 stops when a rear end (upstream end in the conveying direction (the first direction)) of the sheet S1 arrives at a position A as illustrated in FIG. 11B based on information of a size of the sheet in the conveying direction and recognized in advance (S836 to S838). Here, when a clock count has reached 300 since the front end of the sheet S1 was sensed, the rear end of the sheet S1 arrives at the position A and the buffer conveying motor M112 is stopped.

Figure 11C:
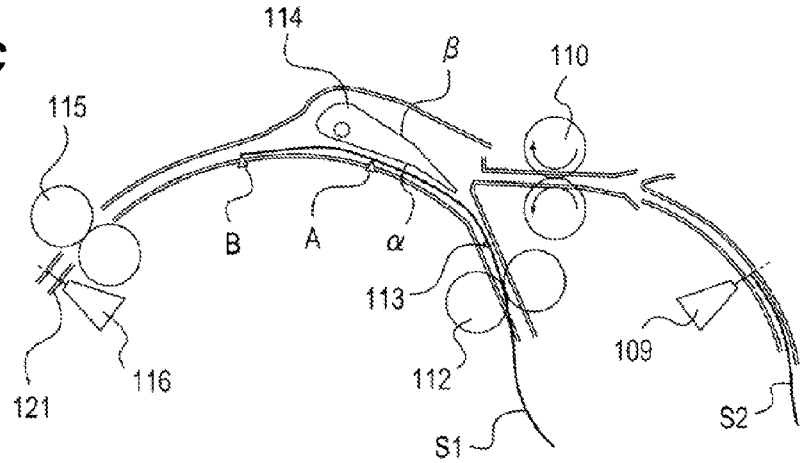

When the rear end of the sheet S1 has arrived at the position A, a switch member motor M114 moves the switch member 114 to a lower position illustrated in FIG. 11B for guiding the sheet toward a buffer path 113 (S839 to S841). Furthermore, the pair of second buffer conveying rollers 115 starts reverse conveyance in the second direction (S842). As a result, the sheet S1 is guided by the first guide face α of the switch member 114 at the lower position and the rear end portion of the sheet S1 is guided into the buffer path 113 as illustrated in FIG. 11C. Then, the sheet S1 is reversely conveyed by the pair of second buffer conveying rollers 115 until the front end of the sheet S1 arrives at the position B and the stop control is performed (S843 to S847). In this way, the sheet S1 is made to wait in the buffer path 113.

Next, the operation goes to a primary buffering superimposing process (S848) (see FIG. 15) to perform the superimposing process of the sheet S1 and the sheet S2 on each other. In other words, the operation goes to the process for sequentially causing the sheets to wait in the buffer path 113.

First, as illustrated in FIG. 12A, the switch member 114 is returned to the upper position which is the home position. At a time when arrival of the switch member 114 at the upper position is completed, the following sheet S2 is conveyed while guided by the first guide face α of the switch member 114 at the upper position. For the reversing process of the sheet S1, time for reciprocating the switch member 114 from the home position (upper position) to the position (lower position) for guiding toward the buffer path 113 and then to the home position is required between arrival of the sheet S1 and arrival of the sheet S2.

Figure 17:
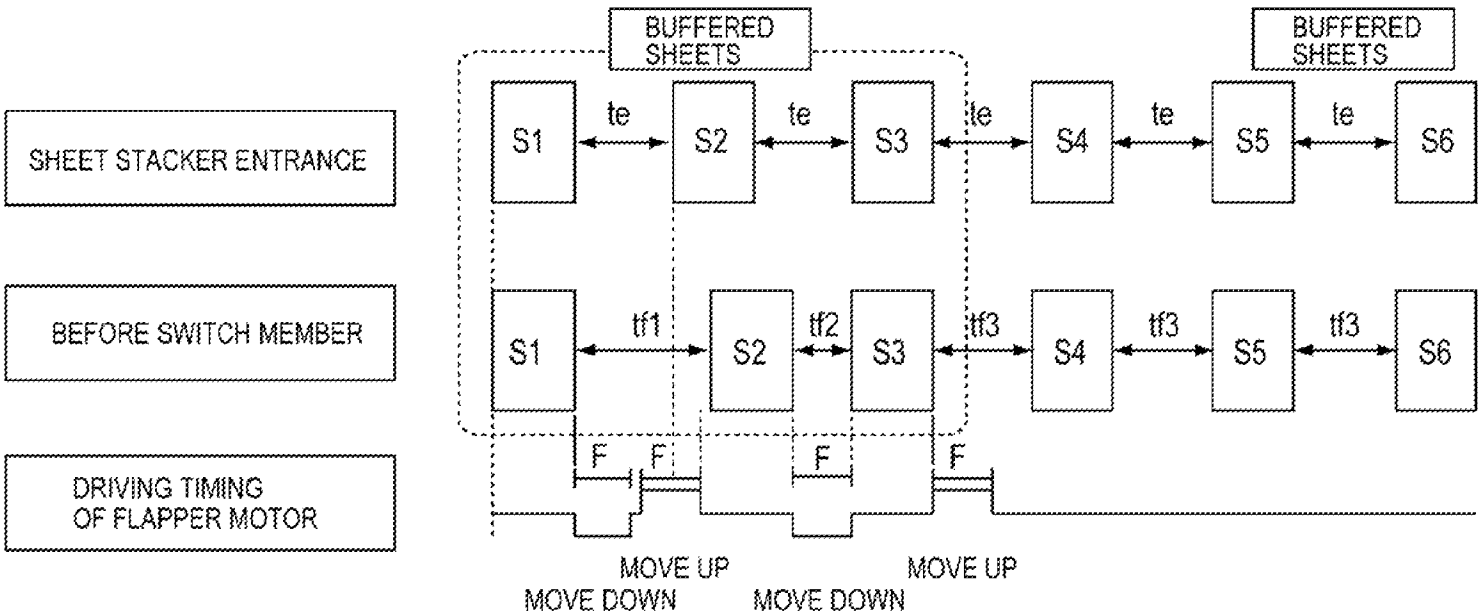
FIG. 17 is an explanatory view for describing control timing of the sheet processing apparatus according to the second embodiment.
Figure 18:
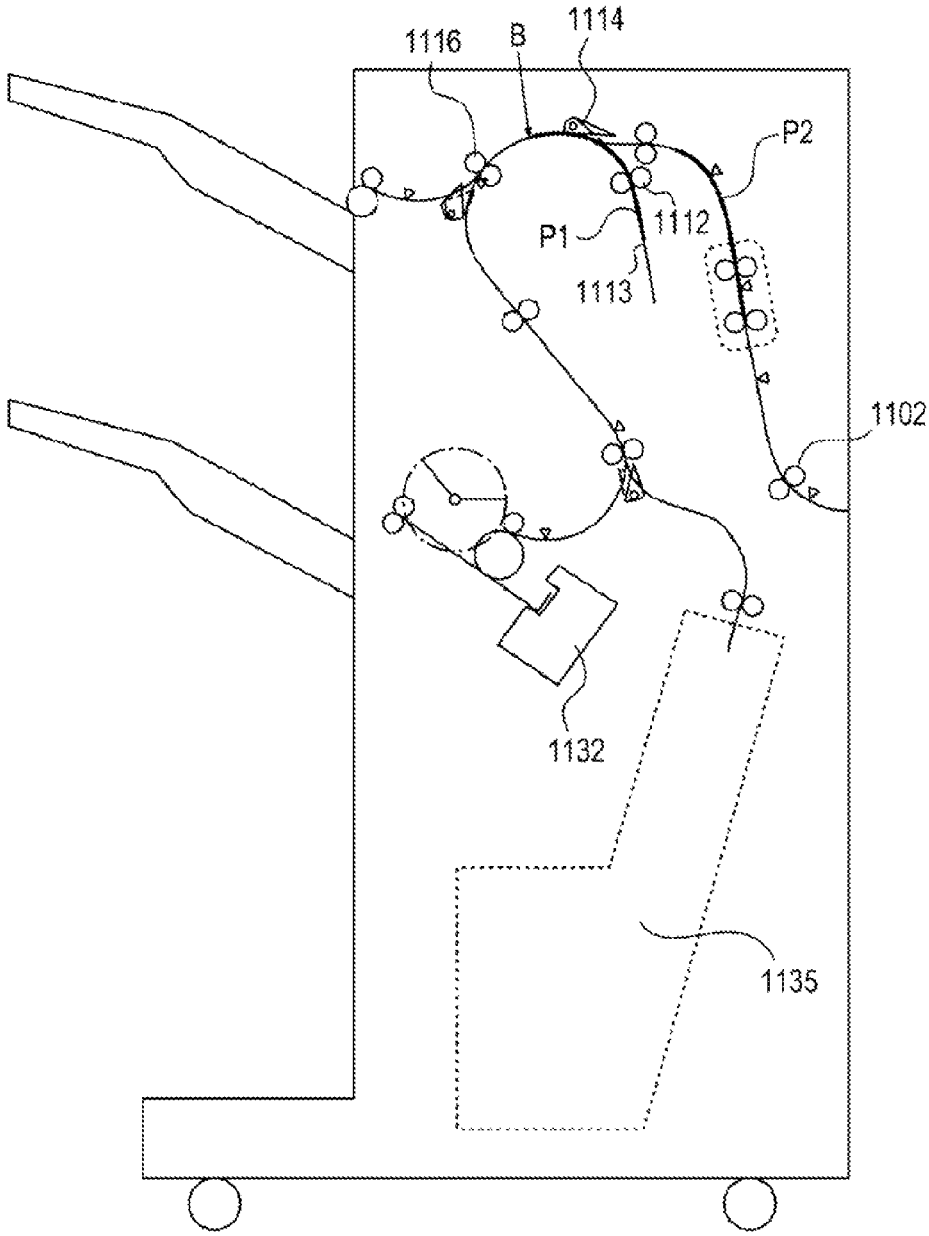
FIG. 18 PRIOR ART
FIG. 18 is a sectional view for describing a prior-art (U.S. Patent Application Publication No. 2007/0075479 A1) sheet processing apparatus.
Figure 19:
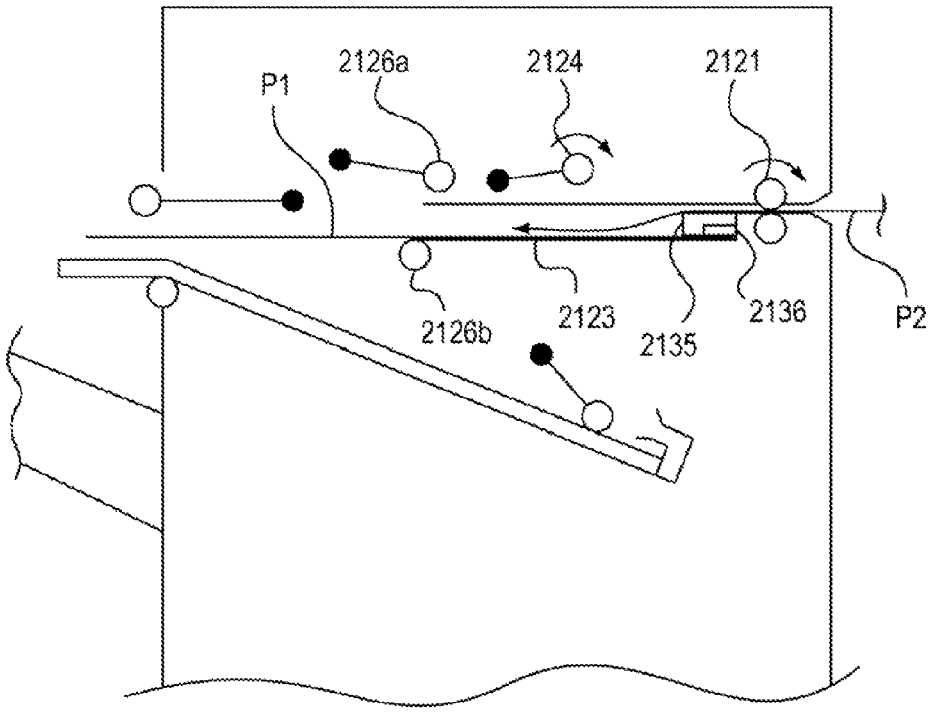
FIG. 19 PRIOR ART
FIG. 19 is a sectional view for describing a prior-art (U.S. Patent Application Publication No. 2004/0175217 A1) sheet processing apparatus.

Therefore, in order to delay arrival time of the second sheet S2 at the switch member 114 from the first sheet S1, the second sheet S2 is conveyed at a lower velocity than the first sheet S1. To put it concretely, in the present embodiment, as illustrated in FIG. 17, regarding a conveyance control of the sheet S2, the sheet S2 is conveyed at the lower velocity than the sheet S1 until it arrives at the switch member 114 to increase a conveying interval tf1 (sheet interval) between the sheet S1 and the sheet S2. Therefore, the control is performed so that all of a moving-down time F of the switching member 114 to the lower position, a stop time at the lower position, and a moving-up time F to return to the upper position end during the conveying interval tf1 between the sheet S1 and the sheet S2.

Next, a front end of the following sheet S2 arrives at a position C illustrated in FIG. 12A (S849 to 852). Then, the pair of first buffer conveying rollers 112 is activated to start acceleration at a predetermined time so that the front ends of the sheet S1 stopped in the buffer path 113 and the sheet S2 are aligned with each other (S853, S854).

Furthermore, when the rear ends of the sheet S1 and the sheet S2 arrive at the position A (S855, S856), the switch member motor M114 moves the switch member 114 to the lower position illustrated in FIG. 12B for guiding the sheets S1 and S2 toward the buffer path 113 (S859). Moreover, the pair of second buffer conveying rollers 115 starts reverse conveyance (S860). As a result, the sheets S1 and S2 are guided by the first guide face α of the switch member 114 at the lower position and the rear end portions of the sheets S1 and S2 are guided into the buffer path 113. Then, the sheets S1 and S2 are reversely conveyed by the pair of second buffer conveying rollers 115 until their front ends arrive at the position B and then a stop control is performed (S861 to S865). As a result, the sheets S1 and S2 are sequentially made to wait in the buffer path 113.

Next, the operation goes to a secondary buffering superimposing process (S866) (see FIG. 16). The switch member 114 waits for arrival of the following sheet S3 conveyed by the pair of pre-buffer conveying rollers 110 while maintained at the lower position for guiding the preceding sheets toward the buffer path 113.

At this time, the following sheet S3 is controlled to be conveyed at an equal conveying velocity to the sheet S1. Therefore, a conveying interval tf2 between the sheet S2 and the sheet S3 is shorter than the above-described conveying interval tf1 between the sheet S1 and the sheet S2. The secondary buffering superimposing process does not include a moving-up operation control for returning the switch member 114 to the home position. Therefore, even if the conveying interval tf2 between the sheet S2 and the sheet S3 is shorter than the conveying interval tf1 between the sheet S1 and the sheet S2, it does not cause a jam in which the sheet collides with the switch member 114.

Therefore, the sheet S3 is conveyed toward the pair of second buffer conveying rollers 115 while guided by the second guide face β of the switch member 114 at the upper position. Then, the following sheet S3 is conveyed side by side with the sheets S1 and S2 which have started accelerating (S817) at a time when the front end of the sheet S3 arrives at the position C and meets the sheets S1 and S2 at a downstream portion of the switch member 114 so that front ends of the sheets are aligned with each other (see FIG. 13A).

After the sheets S1, S2, and the sheet S3 meet each other at the downstream portion of the switch member 114, acceleration of the sheets S1 and S2 ends and the sheets S1 and S2 are conveyed at the equal velocity to the sheet S3. As illustrated in FIG. 13B, the sheets S1 to S3 are nipped by the pair of second buffer conveying rollers 115 with their front ends aligned with each other and the front ends pass the second buffer sensor 116 as a sheet bundle (S874) to complete the buffering process (S875). The sheet bundle which has been subjected to the buffering process is discharged to the downstream upper discharge tray 136, the processing tray 138, or the saddle unit 135.

Because the similar control to the above-described operation processes (FIGS. 5A to 5C and 6A to 6C) of the sheet stacker 100 is performed in a case of the buffering process for two sheets, description will not be repeated. In the embodiment, as described above, the three sheets are put together into the bundle in the buffering processing portion and discharged to the upper discharge tray 136, the processing tray 138, or the saddle unit 135. In this way, in performing the side binding process or the saddle (saddle binding) process, it is possible to process the sheets in the sheet processing apparatus without stopping the image forming operation of the image forming apparatus main body 600 to thereby further increase productivity of the entire system. Moreover, by reducing operations of the switch member 114 in superimposing the sheets on each other as in the embodiment, it is possible to widely adapt to increase in the production number of sheets P with small sheet intervals, low-speed conveyance, and the like.

Other Embodiments

Although the four image forming portions for forming the image on the sheet are used in the embodiments described above, the number and colors of the image forming portions to be used are not limited to those in the embodiments but may be changed properly as needed.

The image forming apparatus may be an image forming apparatus such as a printer, a copying machine, and a facsimile or other image forming apparatuses such as a combined machine combining their functions. By applying the invention to the sheet conveying apparatus in each of the image forming apparatuses, similar effects can be obtained.

Although the sheet processing apparatus which is detachably attached to the image forming apparatus has been shown as an example in each of the above-described embodiments, the invention is not limited to it. For example, the sheet processing apparatus may be the sheet processing apparatus that the image forming apparatus integrally has. By applying the invention to the sheet conveying apparatus in the sheet processing apparatus, similar effects can be obtained.

With the invention, the processing velocity at which the sheets are conveyed in a bundle increases to thereby further increase productivity and the invention can adapt to the highly-productive apparatus.

Moreover, even in the case of the highly-productive apparatus, it is possible to convey thin sheets in a bundle to thereby further improve the conveying performance and the stacking performance.

Furthermore, it is possible to reduce the operating time of the apparatus to reduce the power consumption.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-276697, filed Dec. 13, 2010, and No. 2011-249455, filed Nov. 15, 2011, which are hereby incorporated by reference herein in their entirety.

What is claimed is:

1. A sheet conveying apparatus which superimposes and conveys a plurality of sheets, comprising:

a common conveying route configured to convey a sheet in a first direction;

a reverse conveying route which branches off from the common conveying route and receives the sheet conveyed from the common conveying route in a second direction opposite to the first direction, to make the sheet waiting in the reverse conveying route;

a conveying portion which conveys the sheet in the first direction or in the second direction along the common conveying route or the reverse conveying route;

a switch member which is provided at a branch portion between the common conveying route and the reverse conveying route, which can be switched between a first position for guiding the sheet conveyed along the common conveying route from upstream to downstream of the branch portion in the first direction and a second position for guiding the sheet conveyed in the second direction from downstream of the branch portion in the first direction, and which has a first guide face and a second guide face, located on a back of the first guide face, to guide the sheet; and a controlling portion which controls operations of the conveying portion and the switch member, so that a preceding sheet, conveyed in the second direction to wait in the reverse conveying route, is guided by the first guide face of the switch member switched from the first position to the second position, and so that a following sheet, conveyed along the common conveying route from upstream of the branch portion in the first direction to be superimposed with the preceding sheet waiting in the reverse conveying route, is guided by the second guide face of the switch member while the switch member is maintained at the second position so as to meet the preceding sheet guided from the reverse conveying route by the first guide face of the switch member at a position downstream of the switch member in the first direction.

2. The sheet conveying apparatus according to claim 1, wherein the controlling portion controls the operations of the conveying portion and the switch member so that the preceding sheet conveyed along the common conveying route in the first direction from upstream of the branch portion in the first direction is guided by the first guide face of the switch member at the first position, the switch member is switched to the second position after an upstream end of the preceding sheet in the first direction passes the branch portion, and the preceding sheet conveyed in the second direction from downstream of the branch portion in the first direction is guided by the first guide face of the switch member at the second position and is conveyed to the reverse conveying route.

3. The sheet conveying apparatus according to claim 1, wherein the controlling portion controls the operations of the conveying portion and the switch member so that when sheets are made to wait in the reverse conveying route sequentially, a first preceding sheet conveyed along the common conveying route in the first direction from upstream of the branch portion is guided by the first guide face of the switch member at the first position, the switch member is switched to the second position after an upstream end of the first preceding sheet in the first direction passes the branch portion, the first preceding sheet conveyed in the second direction from downstream of the branch portion in the first direction is guided by the first guide face of the switch member at the second position and made to wait in the reverse conveying route, the second preceding sheet is conveyed at a lower velocity to delay arrival time of the second preceding sheet at the switch member from that of the first preceding sheet after switching the switch member to the first position, the second preceding sheet is guided by the first guide face of the switch member at the first position and made to wait in the reverse conveying route, and these operations are repeated.

4. The sheet conveying apparatus according to claim 1, wherein a meeting position of the preceding sheet conveyed from the reverse conveying route and a downstream end of the following sheet in the first direction is positioned downstream, in the first direction, of the downstream end, in the first direction, of the preceding sheet waiting in the reverse conveying route.

5. The sheet conveying apparatus according to claim 4, wherein the conveying portion is not disposed in the conveying route between the switch member and the meeting position.

6. The sheet conveying apparatus according to claim 1, wherein the conveying portion has a pair of conveying rollers which nips and conveys the sheet and which can be rotated in normal and reverse directions.

7. The sheet conveying apparatus according to claim 1, further comprising:

a stacking portion on which sheets are stacked, wherein the control portion controls the operations of the conveying portion so that superimposed sheets are conveyed in the first direction to be stacked on the stacking portion.

8. A sheet processing apparatus comprising:

a stacking portion on which sheets are stacked;

a processing portion which performs a process for the sheets stacked on the stacking portion;

a common conveying route configured to convey the sheet in a first direction;

a reverse conveying route which branches off from the common conveying route and receives the sheet conveyed from the common conveying route in a second direction opposite to the first direction, to make the sheet waiting in the reverse conveying route;

a conveying portion which conveys the sheet in the first direction or in the second direction along the common conveying route or the reverse conveying route;

a switch member which is provided at a branch portion between the common conveying route and the reverse conveying route, which can be switched between a first position for guiding the sheet conveyed along the common conveying route from upstream to downstream of the branch portion in the first direction and a second position for guiding the sheet conveyed in the second direction from downstream of the branch portion in the first direction, and which has a first guide face and a second guide face, located on a back of the first guide face, to guide the sheet; and a controlling portion which controls operations of the conveying portion and the switch member, so that a preceding sheet, conveyed in the second direction to wait in the reverse conveying route, is guided by the first guide face of the switch member switched from the first position to the second position, and so that a following sheet, conveyed along the common conveying route from upstream of the branch portion in the first direction to be superimposed with the preceding sheet waiting in the reverse conveying route, is guided by the second guide face of the switch member while the switch member is maintained at the second position so as to meet the preceding sheet guided from the reverse conveying route by the first guide face of the switch member at a position downstream of the switch member in the first direction.

9. The sheet processing apparatus according to claim 8, wherein the controlling portion controls the operations of the conveying portion and the switch member so that the preceding sheet conveyed along the common conveying route from upstream of the branch portion in the first direction is guided by the first guide face of the switch member at the first position, the switch member is switched to the second position after an upstream end of the preceding sheet in the first direction passes the branch portion, and the preceding sheet conveyed in the second direction from downstream of the branch portion in the first direction is guided by the first guide face of the switch member at the second position and is conveyed to the reverse conveying route.

10. The sheet processing apparatus according to claim 8, wherein the controlling portion controls the operations of the conveying portion and the switch member so that when sheets are made to wait in the reverse conveying route sequentially, a first preceding sheet conveyed along the common conveying route in the first direction from upstream of the branch portion is guided by the first guide face of the switch member at the first position, the switch member is switched to the second position after an upstream end of the first preceding sheet in the first direction passes the branch portion, the first preceding sheet conveyed in the second direction from downstream of the branch portion in the first direction is guided by the first guide face of the switch member at the second position and made to wait in the reverse conveying route, the second preceding sheet is conveyed at a lower velocity to delay arrival time of the second preceding sheet at the switch member from that of the first preceding sheet after switching the switch member to the first position, the second preceding sheet is guided by the first guide face of the switch member at the first position and made to wait in the reverse conveying route, and these operations are repeated.

11. The sheet processing apparatus according to claim 8, wherein a meeting position of the preceding sheet conveyed from the reverse conveying route and a downstream end of the following sheet in the first direction is positioned downstream, in the first direction, of the downstream end, in the first direction, of the preceding sheet waiting in the reverse conveying route.

12. The sheet processing apparatus according to claim 11, wherein the conveying portion is not disposed in the conveying route between the switch member and the meeting position.

13. The sheet processing apparatus according to claim 8, wherein the conveying portion has a pair of conveying rollers which nips and conveys the sheet and which can be rotated in normal and reverse directions.

14. The sheet processing apparatus according to claim 8, wherein the control portion controls the operations of the conveying portion so that superimposed sheets are conveyed in the first direction to be stacked on the stacking portion.

15. An image forming system comprising:

an image forming portion for forming an image on a sheet;

a stacking portion on which the sheets on that the images are formed;

a common conveying route configured to convey the sheet in a first direction;

a reverse conveying route which branches off from the common conveying route and receives the sheet conveyed from the common conveying route in a second direction opposite to the first direction;

a conveying portion which conveys the sheet in the first direction or in the second direction along the common conveying route or the reverse conveying route;

a switch member which is provided at a branch portion between the common conveying route and the reverse conveying route, which can be switched between a first position for guiding the sheet conveyed along the common conveying route from upstream to downstream of the branch portion in the first direction and a second position for guiding the sheet conveyed in the second direction from downstream of the branch portion in the first direction, and which has a first guide face and a second guide face, located on a back of the first guide face, to guide the sheet; and a controlling portion which controls operations of the conveying portion and the switch member, so that a preceding sheet, conveyed in the second direction to wait in the reverse conveying route, is guided by the first guide face of the switch member switched from the first position to the second position, and so that a following sheet, conveyed along the common conveying route from upstream of the branch portion in the first direction to be superimposed with the preceding sheet waiting in the reverse conveying route, is guided by the second guide face of the switch member while the switch member is maintained at the second position so as to meet the preceding sheet guided from the reverse conveying route by the first guide face of the switch member at a position downstream of the switch member in the first direction.

16. The image forming system according to claim 15, wherein the controlling portion controls the operations of the conveying portion and the switch member so that the preceding sheet conveyed along the common conveying route from upstream of the branch portion in the first direction is guided by the first guide face of the switch member at the first position, the switch member is switched to the second position after an upstream end of the preceding sheet in the first direction passes the branch portion, and the preceding sheet conveyed in the second direction from downstream of the branch portion in the first direction is guided by the first guide face of the switch member at the second position and is conveyed to the reverse conveying route.

17. The image forming system according to claim 15, wherein the controlling portion controls the operations of the conveying portion and the switch member so that when sheets are made to wait in the reverse conveying route, a first preceding sheet conveyed along the common conveying route in the first direction from upstream of the branch portion in the first direction is guided by the first guide face of the switch member at the first position, the switch member is switched to the second position after an upstream end of the first preceding sheet in the first direction passes the branch portion, the first preceding sheet conveyed in the second direction from downstream of the branch portion in the first direction is guided by the first guide face of the switch member at the second position and made to wait in the reverse conveying route, the second preceding sheet is conveyed at a lower velocity to delay arrival time of the second preceding sheet at the switch member from that of the first preceding sheet after switching the switch member to the first position, the second preceding sheet is guided by the first guide face of the switch member at the first position and made to wait in the reverse conveying route, and these operations are repeated.

18. The image forming system according to claim 15, wherein a meeting position of the preceding sheet conveyed from the reverse conveying route and a front end of the following sheet is positioned downstream, in the first direction, of the downstream end, in the first direction, of the preceding sheet waiting in the reverse conveying route.

19. The image forming system according to claim 18, wherein the conveying portion is not disposed in the conveying route between the switch member and the meeting position.

20. The image forming system according to claim 15, wherein the conveying portion has a pair of conveying rollers which nips and conveys the sheet and which can be rotated in normal and reverse directions.

21. The image forming system according to claim 15, wherein the control portion controls the operations of the conveying portion so that superimposed sheets are conveyed in the first direction to be stacked on the stacking portion.

* * * * *